US010926970B2

(12) United States Patent
Tanoue et al.

(10) Patent No.: US 10,926,970 B2
(45) Date of Patent: Feb. 23, 2021

(54) POST-PROCESSING APPARATUS, IMAGE FORMING APPARATUS INCORPORATING THE SAME, AND IMAGE FORMING SYSTEM INCORPORATING THE SAME

(71) Applicant: Ricoh Company, Ltd., Tokyo (JP)

(72) Inventors: Shinji Tanoue, Kanagawa (JP); Katsuji Yamaguchi, Kanagawa (JP); Akikazu Iwata, Kanagawa (JP); Ken Sawada, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 16/668,689

(22) Filed: Oct. 30, 2019

(65) Prior Publication Data

US 2020/0172367 A1 Jun. 4, 2020

(30) Foreign Application Priority Data

Nov. 30, 2018 (JP) ..... JP2018-225376

(51) Int. Cl.
*B65H 37/04* (2006.01)
*B42C 1/12* (2006.01)
*B31F 1/07* (2006.01)

(52) U.S. Cl.
CPC ..... *B65H 37/04* (2013.01); *B42C 1/12* (2013.01); *B31F 1/07* (2013.01); *B31F 2201/07* (2013.01);
(Continued)

(58) Field of Classification Search
CPC ..... B42C 1/12; B31F 1/07; B31F 5/02; B31F 2201/07; B31F 2201/0771;
(Continued)

(56) References Cited

U.S. PATENT DOCUMENTS 7,703,758 B2 4/2010 Kamiya et al.
8,087,654 B2 * 1/2012 Awano ..... G03G 15/6541 270/58.11
(Continued)

FOREIGN PATENT DOCUMENTS

CN 1449927 A 10/2003
CN 101357720 A 2/2009
(Continued)

OTHER PUBLICATIONS

Chinese Office Action dated Dec. 28, 2020.

*Primary Examiner* — Leslie A Nicholson, III
(74) *Attorney, Agent, or Firm* — Harness, Dickey & Pierce, P.L.C.

(57) ABSTRACT

A post-processing apparatus includes a binding tool configured to bind a sheet bundle, a binding tool driver, and control circuitry. The binding tool driver is configured to apply a driving force to move the binding tool to a first binding position at which the binding tool executes a first binding process on the sheet bundle and a second binding position different from the first binding position. At the second binding position, the binding tool executes a second binding process on the sheet bundle. The control circuitry is configured to cause the binding tool driver to move the binding tool to the first binding position at a first movement speed to execute the first binding process, and move the binding tool from the first binding position to the second binding position at a second movement speed slower than the first movement speed to execute the second binding process.

9 Claims, 23 Drawing Sheets

(52) U.S. Cl.
CPC ..... *B31F 2201/0771* (2013.01); *B31F 2201/0774* (2013.01); *B65H 2301/43828* (2013.01); *B65H 2301/51616* (2013.01); *G03G 2215/00852* (2013.01)

(58) Field of Classification Search
CPC ..... B31F 2201/0774; G03G 15/6544; G03G 2215/00852; B65H 37/04; B65H 2301/43828; B65H 2301/51616
USPC ..... 270/58.07, 58.08
See application file for complete search history.

(56) References Cited

U.S. PATENT DOCUMENTS

| | | | | |
|---|---|---|---|---|
| 2004/0104529 | A1 | 6/2004 | Sato et al. | |
| 2007/0063411 | A1* | 3/2007 | Hirano | B42C 1/12 270/58.11 |
| 2009/0036287 | A1 | 2/2009 | Kawaguchi et al. | |
| 2010/0237556 | A1 | 9/2010 | Azuma et al. | |
| 2011/0033218 | A1* | 2/2011 | Sasahara | G03G 15/6538 399/410 |
| 2011/0074081 | A1 | 3/2011 | Hirabayashi et al. | |
| 2015/0003938 | A1 | 1/2015 | Morinaga et al. | |
| 2015/0329308 | A1 | 11/2015 | Iwata et al. | |
| 2015/0329309 | A1 | 11/2015 | Iwata et al. | |
| 2015/0336765 | A1 | 11/2015 | Sawada et al. | |
| 2016/0340145 | A1* | 11/2016 | Kunieda | B41F 19/02 |
| 2017/0267483 | A1 | 9/2017 | Sawada et al. | |
| 2018/0370751 | A1 | 12/2018 | Sawada et al. | |

FOREIGN PATENT DOCUMENTS

| | | | |
|---|---|---|---|
| EP | 0054351 | A2 | 6/1982 |
| JP | 2002-234662 | A | 8/2002 |
| JP | 2008-279661 | | 11/2008 |
| JP | 2015-009525 | | 1/2015 |
| JP | 2015-157477 | | 9/2015 |
| JP | 2016-216227 | | 12/2016 |

* cited by examiner

POST-PROCESSING APPARATUS, IMAGE FORMING APPARATUS INCORPORATING THE SAME, AND IMAGE FORMING SYSTEM INCORPORATING THE SAME

CROSS-REFERENCE TO RELATED APPLICATION

This patent application is based on and claims priority pursuant to 35 U.S.C. § 119 to Japanese Patent Application No. 2018-225376, filed on Nov. 30, 2018 in the Japan Patent Office, the entire disclosure of which is hereby incorporated by reference herein.

BACKGROUND

Technical Field

This disclosure relates to a post-processing apparatus, an image forming apparatus incorporating the post-processing apparatus, and an image forming system incorporating the post-processing apparatus.

Background Art

There is a post-processing apparatus that stacks and aligns recording media on which images are formed by the image forming apparatus, executes binding processes by using a binding device, and then sequentially ejects a bound bundle of recording media to an ejection tray. The post-processing apparatus is an independent apparatus separate from the image forming apparatus and is coupled to the image forming apparatus to work together and constitute an image forming system. There is also the image forming apparatus installed the post-processing apparatus to constitute one apparatus.

One of devices included in the post-processing apparatus is the binding device that executes the binding processes. There are two types of binding devices: a staple binding device that uses a staple to bind a bundle of recording media, and a non-staple binding device that binds a bundle of recording media without using the staple. The non-staple binding device includes binding teeth made of concave and convex teeth, and the binding teeth sandwich and press the bundle of recording media in a direction in which the recording media are stacked, which intertwines fibers of the recording media and binds the recording media.

SUMMARY

This specification describes an improved post-processing apparatus that includes a binding tool configured to bind a sheet bundle, a binding tool driver, and control circuitry. The binding tool driver is configured to apply a driving force to move the binding tool to a first binding position at which the binding tool executes a first binding process on the sheet bundle and a second binding position different from the first binding position. At the second binding position, the binding tool executes a second binding process on the sheet bundle. The control circuitry is configured to cause the binding tool driver to move the binding tool to the first binding position at a first movement speed to execute the first binding process, and move the binding tool from the first binding position to the second binding position at a second movement speed slower than the first movement speed to execute the second binding process.

This specification further describes an improved image forming system that includes an image forming apparatus configured to form images on sheets of recording media, a post-processing apparatus, and control circuitry. The post-processing apparatus includes a binding tool configured to bind a sheet bundle including the sheets of recording media and a binding tool driver. The binding tool driver is configured to apply a driving force to move the binding tool to a first binding position at which the binding tool executes a first binding process on the sheet bundle and a second binding position at which the binding tool executes a second binding process on the sheet bundle. The control circuitry is in at least one of the image forming apparatus and the post-processing apparatus and is configured to cause the binding tool driver to move the binding tool to the first binding position at a first movement speed to execute the first binding process and move the binding tool from the first binding position to the second binding position at a second movement speed slower than the first movement speed to execute the second binding process.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
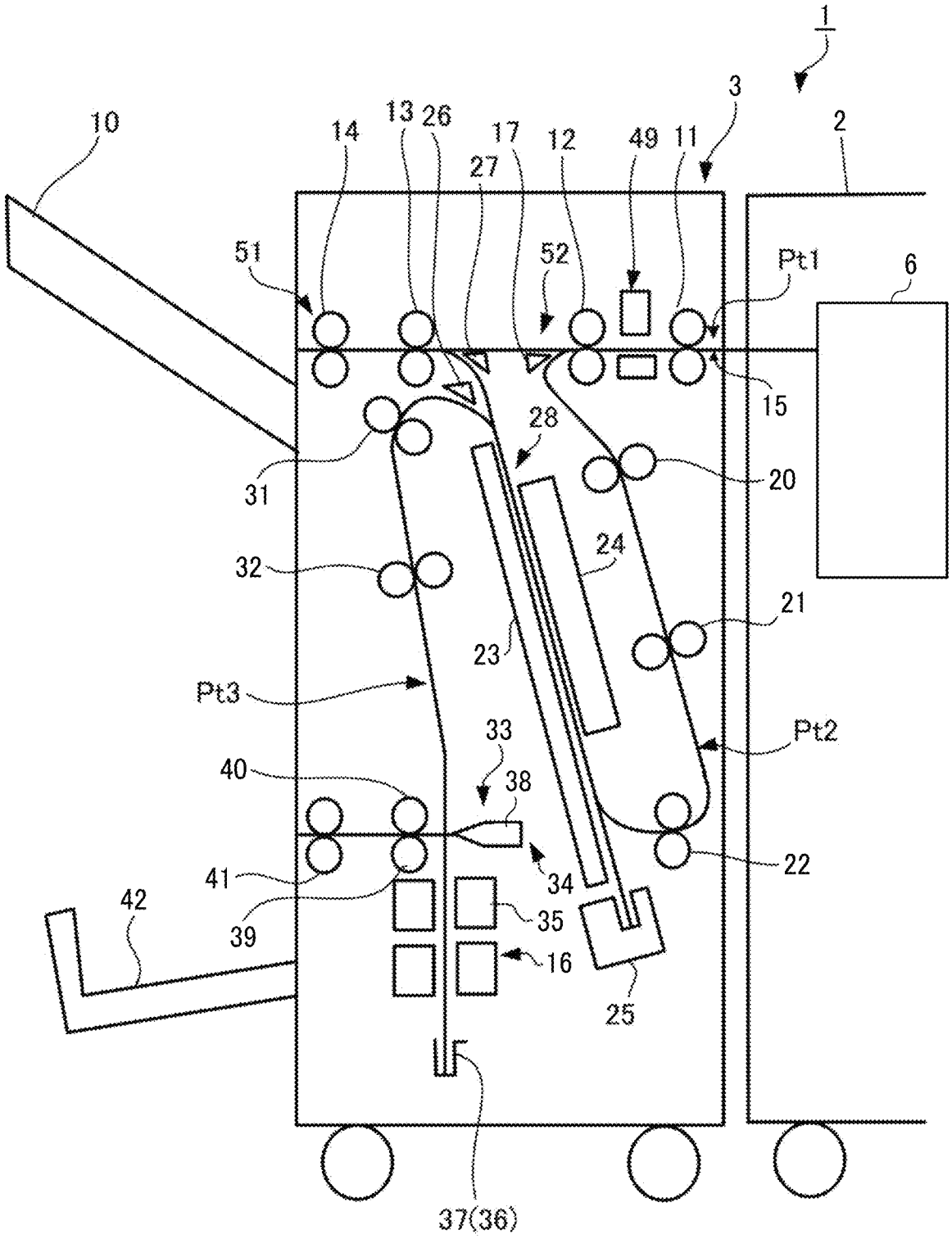
FIG. 1 is a diagram illustrating a configuration of an image forming system according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings illustrating the following embodiments, the same reference numbers are allocated to elements having the same function or shape and redundant descriptions thereof are omitted below.

A post-processing apparatus according the present disclosure relates to a non-staple binding device that executes a non-staple binding process and moves small binding teeth a plurality of times such as twice to execute the binding process. The post-processing apparatus relates to a technology to improve an accuracy for aligning bound portions at both of a first stop position that is a stop position of the binding teeth at a first binding process in one binding job and a second stop position that is the stop position of the binding teeth at a second binding process in the one binding job that includes a plurality of binding processes.

In the present disclosure, a movement speed when the binding teeth moves to the first stop position is referred to as a first movement speed, and a movement speed when the binding teeth moves from the first stop position to the second stop position is referred to as a second movement speed. The gist of the post-processing apparatus according to the present disclosure is to control a driver so that the second movement speed is slower than the first movement speed. Hereinafter, an embodiment of the present disclosure is described with reference to the drawings.

An image forming system 1 according to the present embodiment is described below.

FIG. 1 is a diagram illustrating an entire configuration of the image forming system 1 including a post-processing apparatus 3 according to the embodiment of the present disclosure. As illustrated in FIG. 1, the image forming system 1 includes a printer 2 as an image forming apparatus and the post-processing apparatus 3. The printer 2 and the post-processing apparatus 3 are communicably coupled to each other.

In the image forming system 1, after the printer 2 forms an image on a sheet 4 as a sheet of recording medium, the post-processing apparatus 3 receives the sheet 4 from the printer 2 and executes various types of post-processing on the received sheets 4. The various types of post-processing include, for example, a process to staple sheets at an end portion and a center-folding process to fold a sheet at center. The center-folding process may include a saddle stitching process. The post-processing apparatus 3 that executes such various types of post-processing has operating modes such as an ejection mode, an end portion binding mode, and a center-folding mode.

The printer 2 has a known configuration. For example, the printer 2 may be configured as an electrophotographic color image forming apparatus. The printer 2 includes, for example, a controller, an image forming section 6 including an image forming unit and an optical writing unit, a sheet feeder as a medium supply unit, a sheet feeding conveyance path, a scanner, an intermediate transfer unit, a fixing device, a sheet ejection conveyance path, and a sheet conveyance path for the sheet printed in both sides and forms an image on both sides or one side of the sheet 4.

A configuration of the post-processing apparatus 3 is described below.

The post-processing apparatus 3 includes a first conveyance path Pt1 that receives the sheet 4 ejected from the printer 2 and ejects the sheet 4 to a first output tray 10, a second conveyance path Pt2 that diverges from the first conveyance path Pt1 to staple a bundle 5 of the sheets 4 at the end portion of the bundle 5, and a third conveyance path Pt3 that couples the second conveyance path Pt2 to fold and bind the bundle 5 at a center portion of the bundle 5. Each of the conveyance paths Pt1 to Pt3 is formed by, for example, one or more guide members.

The first conveyance path Pt1 includes entrance rollers 11, conveyance rollers 12 and 13, and sheet ejection rollers 14 which are arranged in that order from upstream to downstream in the first conveyance path Pt1. A motor rotates the entrance rollers 11, the conveyance rollers 12 and 13, and the sheet ejection rollers 14 to convey the sheet. An entrance sensor 15 is disposed upstream from the entrance rollers 11 to detect whether the sheet 4 enters the post-processing apparatus 3. A bifurcating claw 17 is disposed downstream from the conveyance rollers 12. The bifurcating claw 17 pivots to switch its posture, thereby selecting either one of the second conveyance path Pt2 or a downstream portion in the first conveyance path Pt1 from the bifurcating claw 17 and thus guiding the sheet 4 to the selected path. The bifurcating claw 17 is driven by, for example, a motor or a solenoid.

In the ejection mode, the sheet 4 enters the first conveyance path Pt1 from the printer 2, and the entrance rollers 11, the conveyance rollers 12 and 13, and the sheet ejection rollers 14 convey the sheet 4. The sheet ejection rollers 14 eject the sheet 4 to the first output tray 10. On the other hand, in the end portion binding mode and the center-folding mode, the sheet 4 enters the first conveyance path Pt1 from the printer 2, the entrance rollers 11 and the conveyance rollers 12 convey the sheet 4, and the bifurcating claw 17 changes a conveyance direction of the sheet 4 to the conveyance path Pt2.

The second conveyance path Pt2 includes conveyance rollers 20, 21, and 22, a sheet stacker 23, a first sheet jogger 24, and a first binding unit 25 that is a binding unit for the end portion of the bundle. A motor rotates the conveyance rollers 20, 21, and 22 to convey the sheet 4. A motor drives the first sheet jogger 24. Downstream from the sheet stacker 23, the second conveyance path Pt2 includes bifurcating claws 26 and 27. The bifurcating claws 26 and 27 pivot to switch their postures, thereby selecting either one of the third conveyance path Pt3 or a downstream portion in the first conveyance path Pt1 from the bifurcating claw 17 and thus guiding the sheet 4 to the selected path. The bifurcating claws 26 and 27 are driven by, for example, a motor or a solenoid.

As noted above, the post-processing apparatus according to the present disclosure relates to the non-staple binding device and includes the first binding unit 25 that is the binding unit for the end portion of the bundle.

In the end portion binding mode, the sheets are sequentially stacked on the sheet stacker 23. A plurality of sheets 4 stacked forms the sheet bundle 5. At this time, a first movable reference fence disposed in the sheet stacker 23 contacts a trailing end of the sheet 4 to align the plurality of sheets 4 in a sheet conveyance direction, and the first sheet jogger 24 aligns the sheets 4 laterally. The sheet stacker 23, the first sheet jogger 24, and the first movable reference fence constitute a first bundling unit 28 that stacks a plurality of sheets 4 to form the sheet bundle 5. The first bundling unit 28 also includes a motor to drive the first sheet jogger 24 and a motor to drive the first movable reference fence.

The first movable reference fence returns the sheet bundle 5 bound at the end portions of the sheets to the first sheet conveyance path Pt1, and the conveyance rollers 13 and the sheet ejection rollers 14 convey the sheet bundle 5 to eject to the output tray 10. The sheet ejection rollers 14 are an example of a sheet ejection unit to eject the sheet bundle 5 bound by the first binding unit 25 that is the binding unit for the end portion of the bundle.

On the other hand, in the center-folding mode, after the sheet 4 enters the second conveyance path Pt2, the first movable reference fence and the conveyance rollers 20, 21, and 22 conveys the sheet 4 to the third conveyance path Pt3. The third conveyance path Pt3 includes conveyance rollers 31 and 32 and a saddle stitching and folding unit 33. A motor rotates the conveyance rollers 31 and 32 to convey the sheet 4. The saddle stitching and folding unit 33 includes a center-folding unit 34, a second binding unit 35 that is a saddle stitching unit, and a second bundling unit 36. The saddle stitching and folding unit 33 is an example of a bound portion forming unit. In the third conveyance path Pt3, the conveyance rollers 31 and 32 sequentially convey the sheets 4 to stack the sheets 4 in the second bundling unit 36. A plurality of sheets 4 stacked forms the sheet bundle 5. That is, the second bundling unit 36 stacks a plurality of sheets 4 conveyed by a conveyance unit 51 to form the sheet bundle 5. When the sheet bundle 5 is formed, a second movable reference fence 37 contacts a leading end of the sheet 4 to align the sheets 4 in the sheet conveyance direction, and the second sheet jogger aligns the sheets 4 laterally. Subsequently, the second binding unit 35 that is the saddle stitching unit binds the sheet bundle 5 in the vicinity of the center of the sheets in the sheet conveyance direction, that is, executes the saddle stitching process. The saddle-stitched sheet bundle 5 is returned to a center-folding position by the second movable reference fence 37. A motor drives the second movable reference fence 37.

After the sheet bundle 5 is positioned at the center-folding position, the center-folding unit 34 folds the sheet bundle 5 at the center of the sheet bundle 5 in the sheet conveyance direction, that is, executes the center-folding process. In the center-folding unit 34, the sheet bundle 5 is positioned at the center-folding position, and a blade 38 faces the center of the sheet bundle 5 in the sheet conveyance direction. The blade 38 moves from the right to the left in FIG. 1 to push the sheet bundle 5 between a pair of pressing rollers 39 and 40 while the blade 38 bends the sheet bundle 5 at the center of the sheet bundle 5. A motor drives the blade 38. The pair of pressing rollers 39 and 40 presses the top and bottom of the folded sheet bundle 5. A motor rotates the pair of pressing rollers 39 and 40. The pressing rollers 39 and 40 and the sheet ejection rollers 41 eject the folded sheet bundle 5 onto the second output tray 42. A motor drives the sheet ejection rollers 41.

The entrance rollers 11, the conveyance rollers 12, 13, 20, 21, 22, 31, and 32 and the sheet ejection rollers 14 and 41 described above constitute a conveyance unit 51 together with the motors that drive the corresponding rollers. The bifurcating claws 17, 26 and 27 constitute a path switching unit 52 together with the motor or the solenoid for driving the claws.

Figure 2:
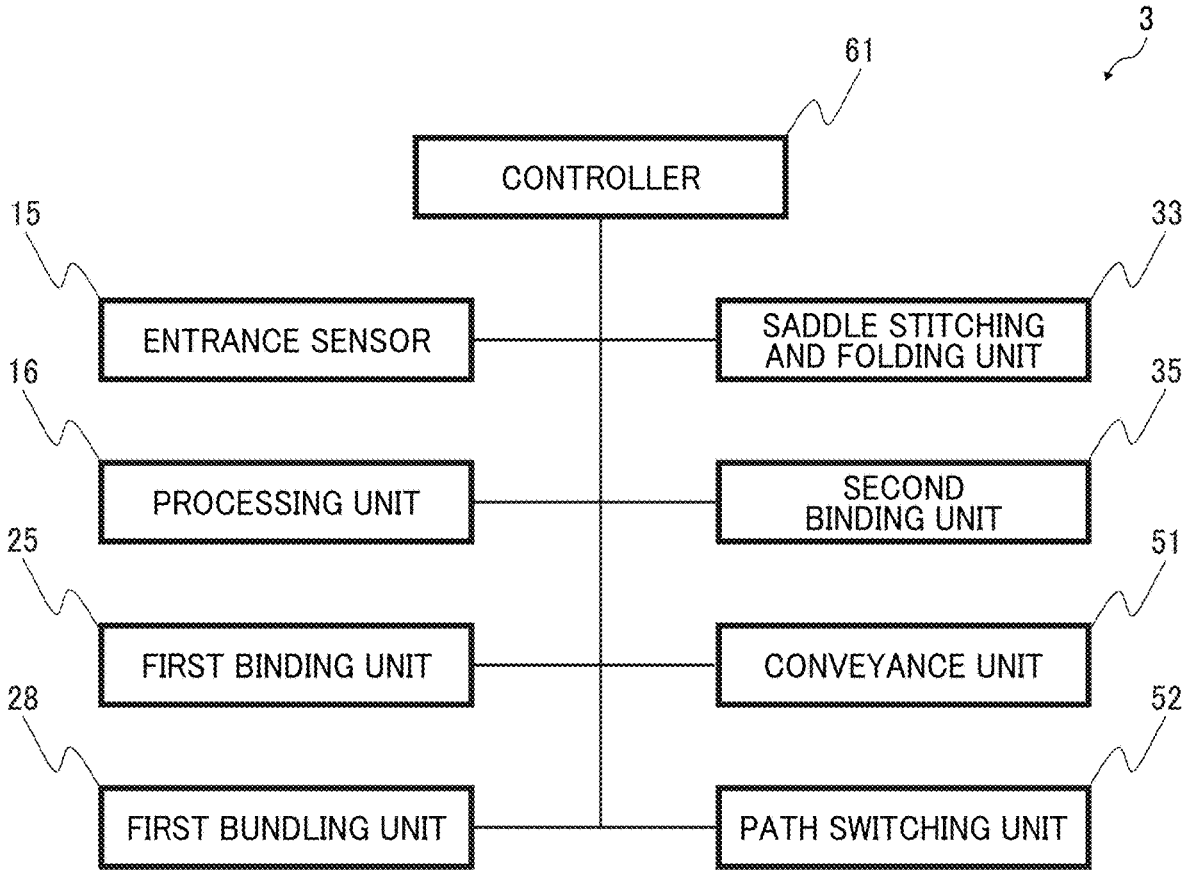
FIG. 2 is a functional block diagram of the image forming system in FIG. 1.

FIG. 2 is a functional block diagram of the post-processing apparatus 3 in the present embodiment according to the present disclosure. As illustrated in FIG. 2, the post-processing apparatus 3 includes a controller 61. The controller 61 is a computer including a central processing unit (CPU), a memory, and a communication interface. The memory in the controller 61 includes a read-only memory (ROM), a random-access memory (RAM), and the like and stores programs executed by the CPU.

The controller 61 is coupled to the entrance sensor 15, a processing unit 16, the first bundling unit 28, the first binding unit 25 that is the binding unit for the end portion of the bundle, the second binding unit 35 that is the saddle stitching unit, the saddle stitching and folding unit 33, the conveyance unit 51, the path switching unit 52. The controller 61 (CPU) controls and drives each unit of the post-processing apparatus 3 according to the programs stored in the memory. The controller 61 is also coupled to a controller in the image forming apparatus to transmit and receive data.

An overall configuration of the post-processing apparatus 3 is described below.

Figure 3A:
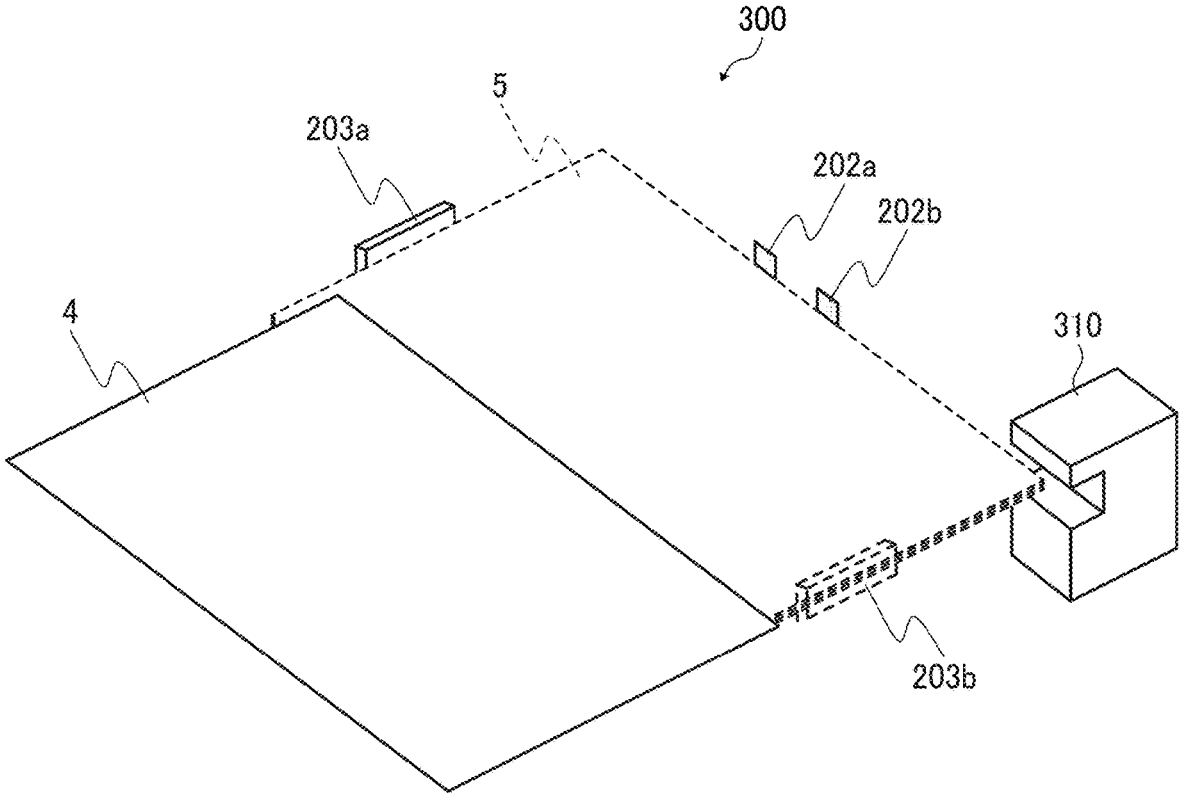
FIG. 3A is a perspective view illustrating an overview of a binding device as an embodiment of a post-processing apparatus according to the present disclosure.

A description is given of a binding device 300 that executes the non-staple binding process in the post-processing apparatus 3 of the present embodiment according to the present disclosure. FIG. 3A is a perspective view illustrating an overview of the binding device 300, and FIG. 3B is a top view illustrating the overview of the binding device 300.

A pair of jogger fences 203*a* and 203*b* aligns, in a sheet width direction, the sheets 4 conveyed and stacked by the conveyance rollers 231 in the first binding unit 25 illustrated in FIG. 1 that is the binding unit for the end portion of the bundle. The sheets 4 aligned in the sheet width direction are aligned in the sheet conveyance direction by a tapping roller with reference to trailing end alignment stoppers 202*a* and 202*b* which are sheet abutting members.

Figure 3B:
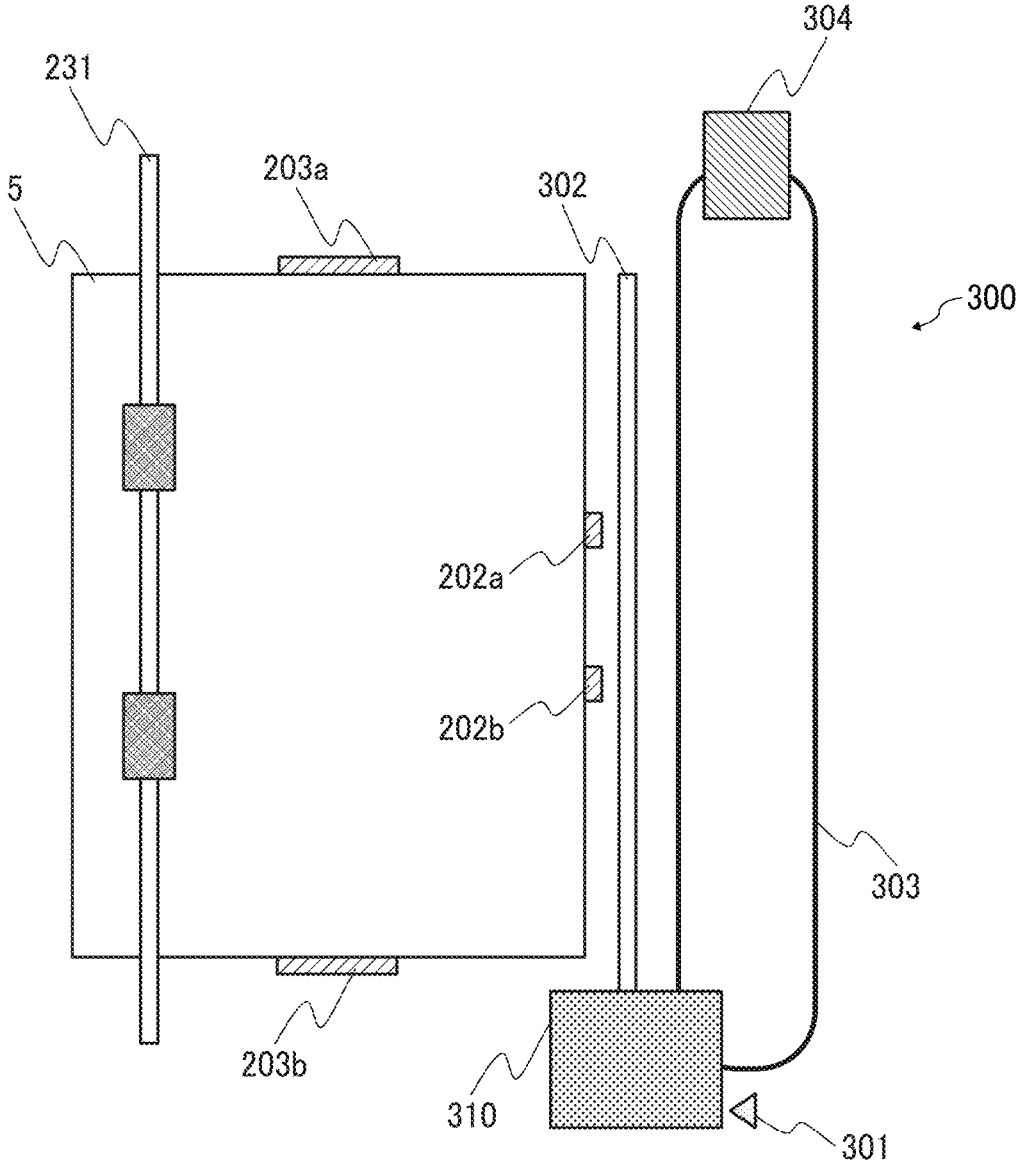
FIG. 3B is a top view illustrating the overview of the binding device as the embodiment of the post-processing apparatus according to the present disclosure.

As illustrated in FIG. 3B, a binding unit home position sensor 301 is disposed outside of the jogger fence 203*b* and detects a home position (initial position) of a binding unit 310 in the binding device 300.

Figure 4A:
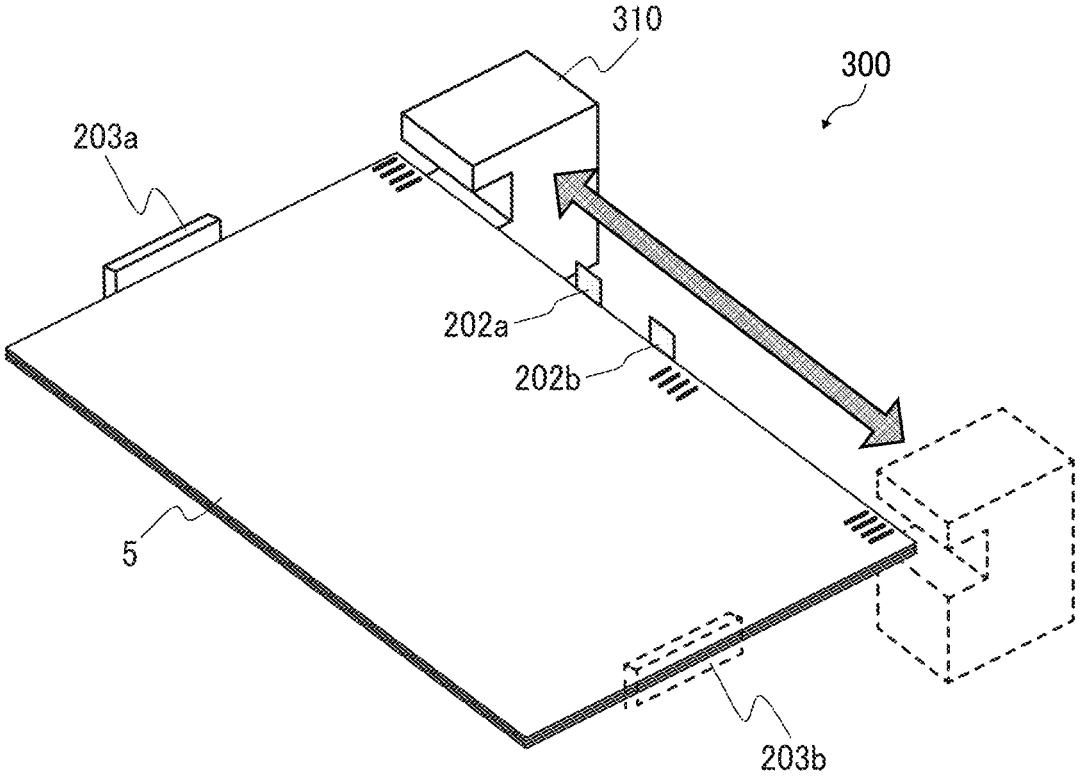
FIG. 4A is a perspective view illustrating an operation of the binding device as the embodiment of the post-processing apparatus according to the present disclosure.
Figure 4B:
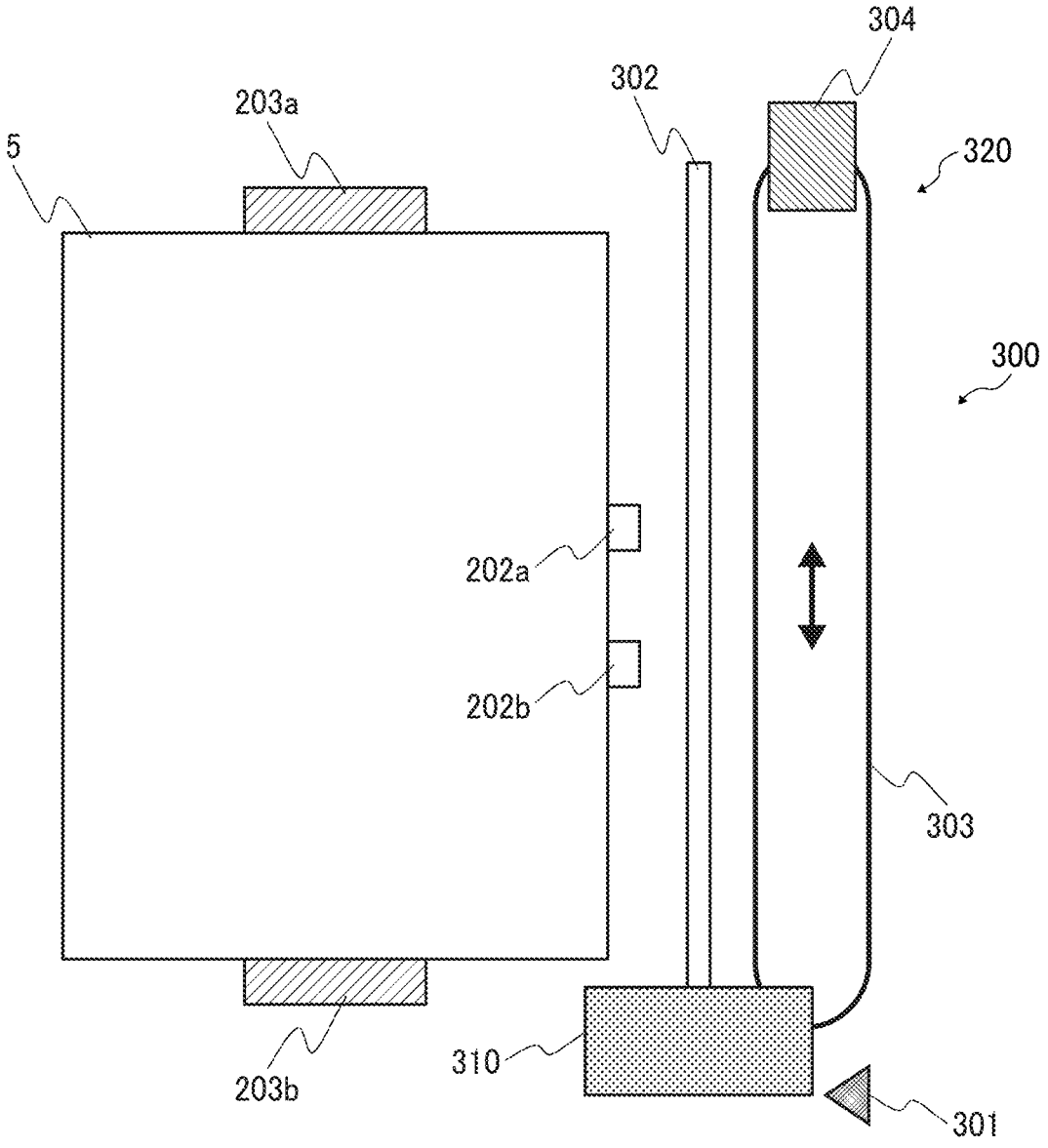
FIG. 4B is a top view illustrating the operation of the binding device as the embodiment of the post-processing apparatus according to the present disclosure.

FIGS. 4A and 4B are diagrams illustrating binding operations of the binding device 300. As illustrated in FIG. 4B, a guide rail 302 for a movement of the binding unit 310 is disposed along the sheet width direction and across an entire area of a binding tray in the sheet width direction and stably guides the binding unit 310 in the binding device 300 so that the binding unit 310 can reciprocate in the sheet width direction. To reciprocate the binding unit 310 in the sheet width direction, a unit movement motor 304 as a first driver rotates to move the binding unit 310. The unit moving belt 303 is wound around a rotation shaft of the unit movement motor 304 and a rotating body disposed opposite the rotation shaft of the unit movement motor 304. The unit movement motor 304 as a driver rotates to move the unit moving belt 303, the movement of the unit moving belt 303 moves the binding unit 310 along the guide rail 302 at a predetermined speed.

With reference to FIG. 5, a configuration of the binding teeth 322 as a binding tool is described.

Figure 5A:
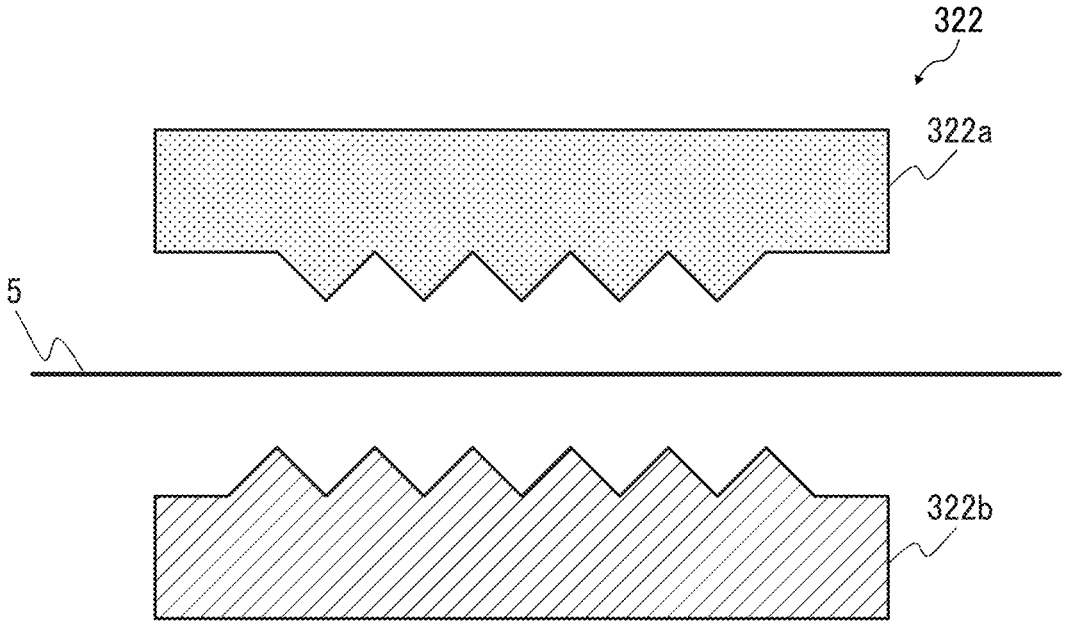
FIGS. 5A and 5B are explanatory diagrams illustrating an embodiment of a binding tool in the binding device.
Figure 5B:
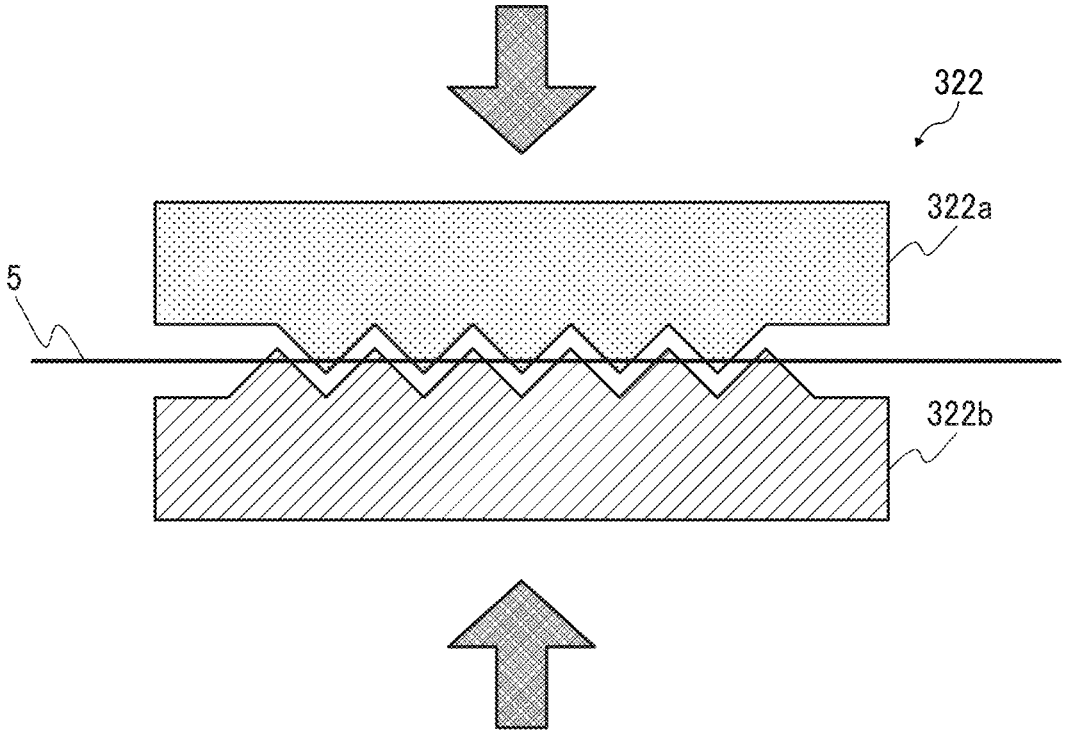

FIGS. 5A and 5B are side views of the binding teeth 322 in the binding unit 310 that is the non-staple binding tool. The binding teeth 322 as the binding tool include upper binding teeth 322*a* and lower binding teeth 322*b*. FIG. 5A illustrates an example of a state before the binding operation of the binding teeth 322. In FIG. 5A, the sheets 4 are conveyed and stacked to form the sheet bundle 5 placed between the upper binding teeth 322*a* and the lower binding teeth 322*b*.

FIG. 5B illustrates an example of a state of the binding teeth 322 during the binding operation. The upper binding teeth 322*a* and the lower binding teeth 322*b* are formed as concave and convex teeth so that the upper binding teeth 322*a* and the lower binding teeth 322*b* can mesh with each other. When the sheet bundle 5 to be bound is placed between the upper binding teeth 322*a* and the lower binding teeth 322*b*, a second driver described below in the binding unit 310 is driven to apply force to both binding teeth to close a gap between both binding teeth. The pressing force from the upper binding teeth 322*a* and the lower binding teeth 322*b* presses the sheet bundle 5 and entangles the fibers of sheets 4 in the sheet bundle 5 with each other. The entanglement of the fibers of the sheets 4 strongly binds the plurality of sheets 4 together and thus binds the sheet bundle 5. Therefore, the stronger the pressing force is, the stronger the binding force that maintains a bound state of the sheet bundle 5 is.

In the present embodiment, the binding force means a force to maintain the bound state of the sheet bundle 5 on which the non-staple binding processes are executed. Therefore, if the binding force is large (that is, strong), the bound state of the sheet bundle 5 is stable.

Figure 6A:
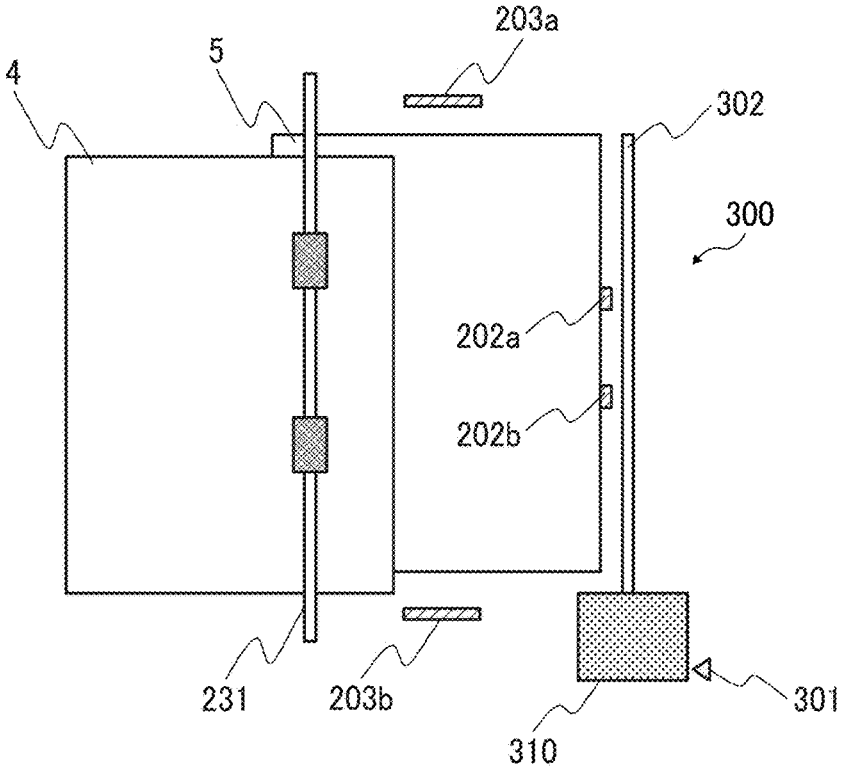
FIGS. 6A to 6C are explanatory diagrams illustrating an example of aligning operation in the binding device according to the present embodiment.
Figure 6B:
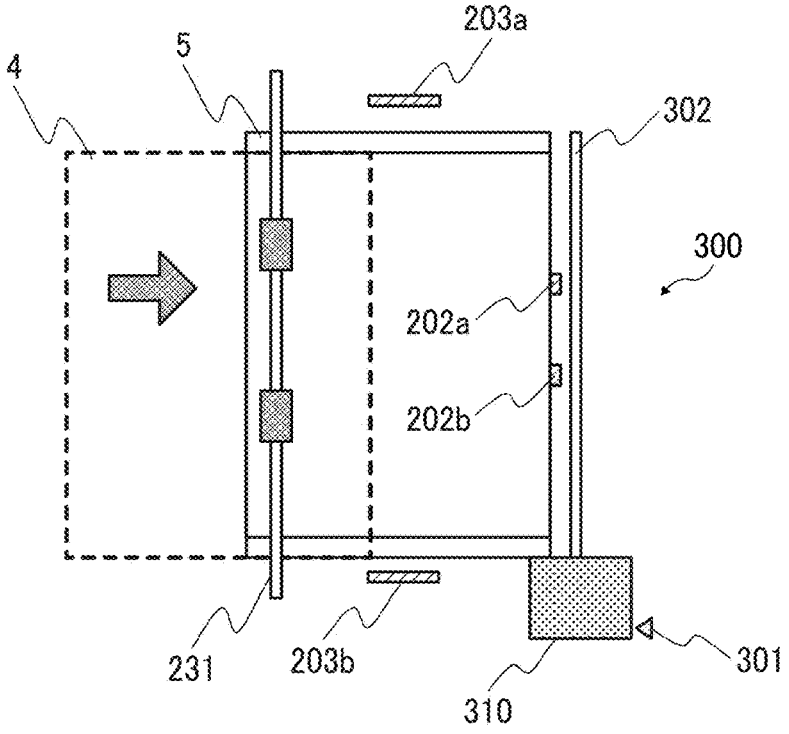
Figure 6C:
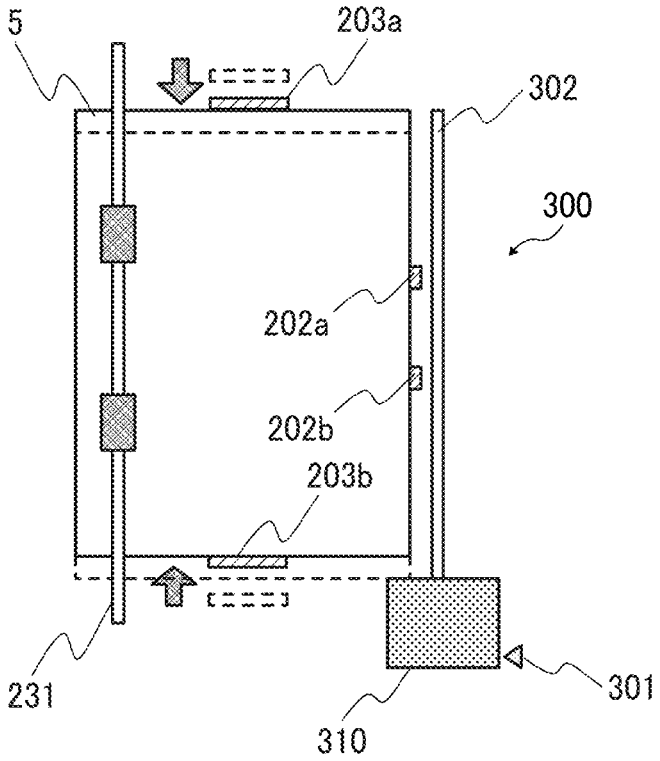

With reference to FIGS. 6A to 6C, an alignment operation for the sheets 4 to form the sheet bundle 5 is described. FIG. 6A illustrates a state when the sheet 4 is conveyed to an alignment position. FIG. 6B illustrates a state when the sheet 4 arrives the alignment position. FIG. 6C illustrates a state when the sheet 4 is aligned with the sheet bundle 5 at the alignment position.

The sheet 4 conveyed to the post-processing apparatus 3 is conveyed to an alignment portion by the conveyance rollers 231 and contacts the trailing end alignment stoppers 202*a* and 202*b* to align the sheet 4 in the sheet conveyance direction. After the sheet 4 contacts the trailing end alignment stoppers 202*a* and 202*b*, the jogger fences 203*a* and 203*b* move to align the sheets 4 laterally, and the alignment of the sheet 4 with the sheet bundle 5 is completed.

Next, a description is given of the post-processing apparatus according to a first embodiment of the present disclosure.

Figure 7:
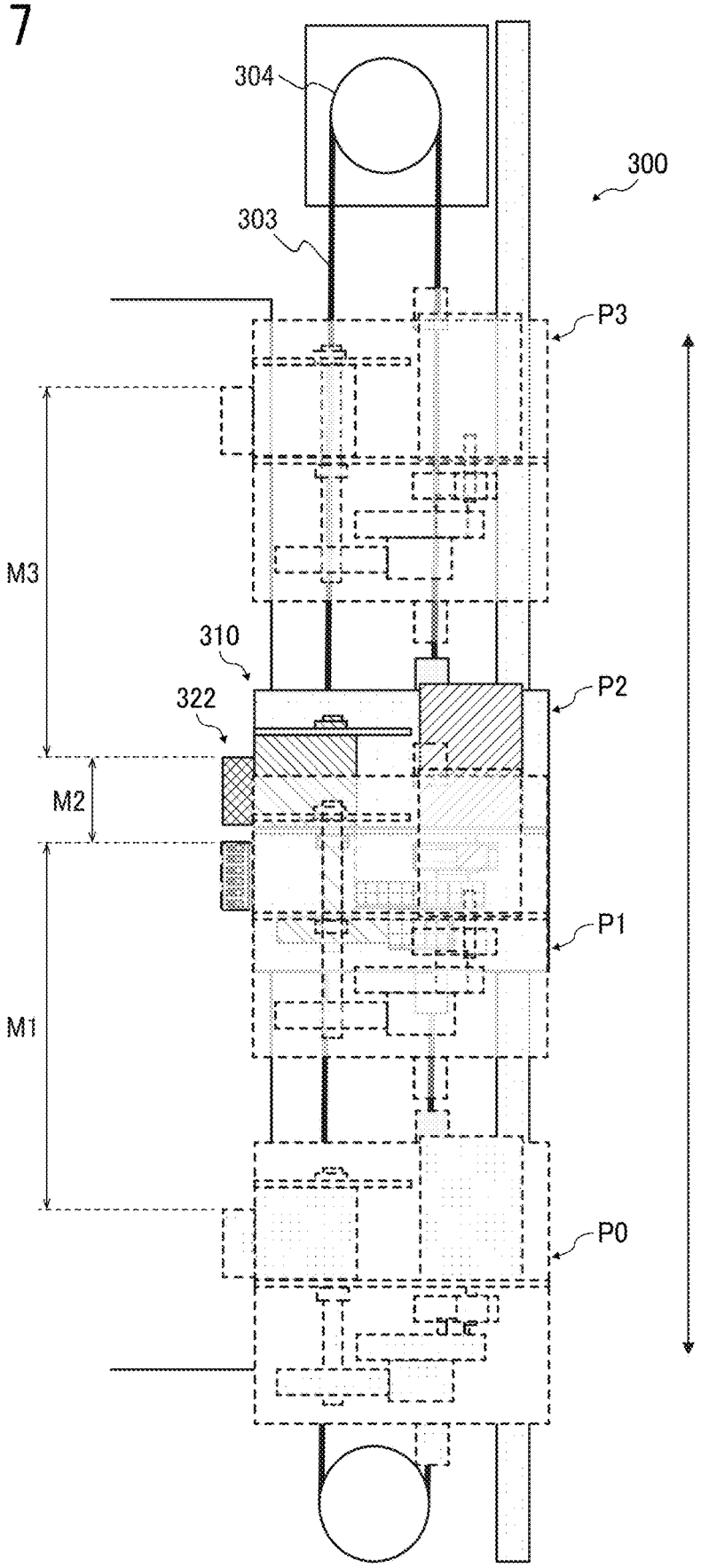
FIG. 7 is an explanatory diagram illustrating an example of operations of a binding unit according to the present embodiment.

Firstly, an outline of operations in the binding processes executed by the binding unit 310 in the binding device 300 according to the present embodiment is described with reference to FIG. 7. FIG. 7 is a plan view illustrating an example of the operations executed when the binding unit 310 executes binding processes at a plurality of positions.

As described above, the binding teeth 322 are attached to the binding unit 310. The binding unit 310 moves along the guide rail 302 when the unit movement motor 304 as the first driver rotates to transmit a driving force to the binding unit 310 via the unit moving belt 303. A rotational speed of the unit movement motor 304 as the first driver controls the movement speed of the binding unit 310. The controller 61 controls the rotational speed and direction of the unit movement motor 304. Therefore, the controller 61 works as control circuitry to control operations of a binding tool driver.

After the binding teeth 322 move to predetermined binding positions, the binding teeth 322 execute the binding operations by a driving force of a motor (described below) that is a second driver to execute binding processes on the sheet bundle 5. Binding process timings of the binding teeth 322 and the binding force in the binding operation correspond to drive timings and a rotational speed of the motor that is the second driver, respectively. The controller 61 controls rotations of the motor that is the second driver.

A flow of the binding processes in the binding unit 310 is described.

As illustrated in FIG. 7, before a start of the binding processes, the binding unit 310 is at the home position P0.

When the non-staple binding processes start, the controller 61 starts the binding processes of the binding unit 310 at the home position P0. The unit movement motor 304 as the first driver rotates to transmit the driving force to the binding unit 310 via the unit moving belt 303. The driving force from the unit movement motor 304 moves the binding unit 310 to a first binding position P1 along the guide rail 302. Hereinafter, the first binding position is sometimes referred to as a first stop position P1.

A moving speed of the binding unit 310 from the home position P0 to the first stop position P1 is defined as the first movement speed.

In the binding unit 310 moved to the first stop position P1, the second driver works to execute a meshing operation of the binding teeth 322 by the driving force of the second driver. As a result, the sheet bundle 5 is bound. The process related to these operations is referred to as a first binding process.

After completion of the first binding process at the first stop position P1, the driving force of the unit movement motor 304 as the first driver moves the binding unit 310 to a second binding position P2 again. Hereinafter, the second binding position is sometimes referred to as a second stop position.

A speed of the binding unit 310 moving from the first stop position P1 to the second stop position P2 is defined as the second movement speed.

In the binding unit 310 that moves to the second position (P2), the second driver described below works to execute the meshing operation of the binding teeth 322 by the driving force of the second driver. As a result, the sheet bundle 5 is bound at a position different from the first stop position. The process related to these operations is referred to as a second binding process.

When the binding unit 310 subsequently executes a next binding process, the driving force of the unit movement motor 304 moves the binding unit 310 to a next binding position P3. Or, the driving force of the unit movement motor 304 returns the binding unit 310 to the home position P0. A speed of a movement from the second stop position P2 to the next binding position P3 and a speed of a movement from the second stop position P2 to the home position P0 are the same first movement speed.

Figure 8B:
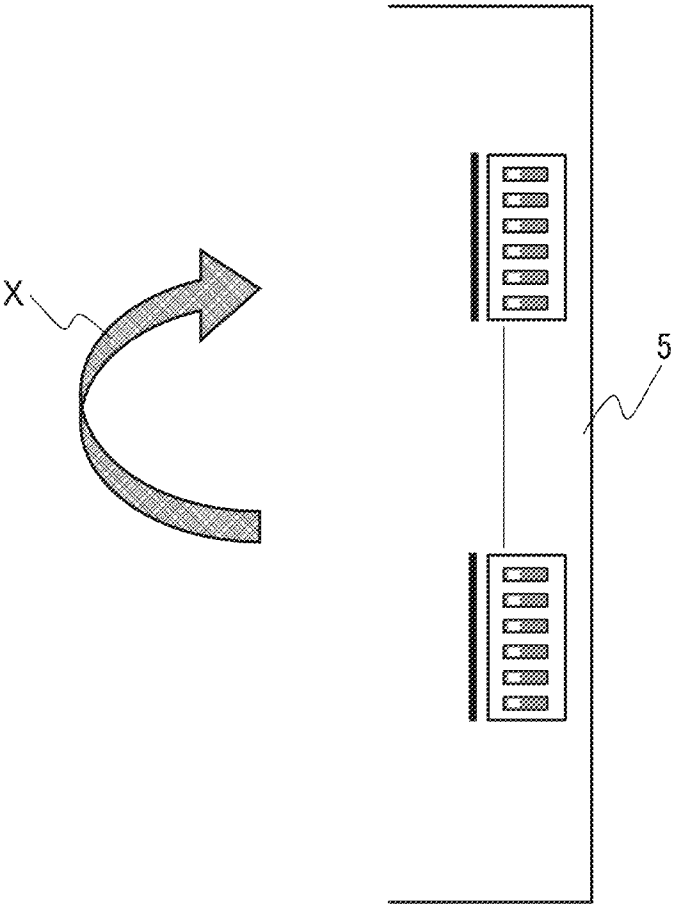
FIG. 8B is a schematic diagram illustrating bound portions of the present embodiment to describe a feature of binding processes of the binding unit according to the present embodiment.
Figure 8A:
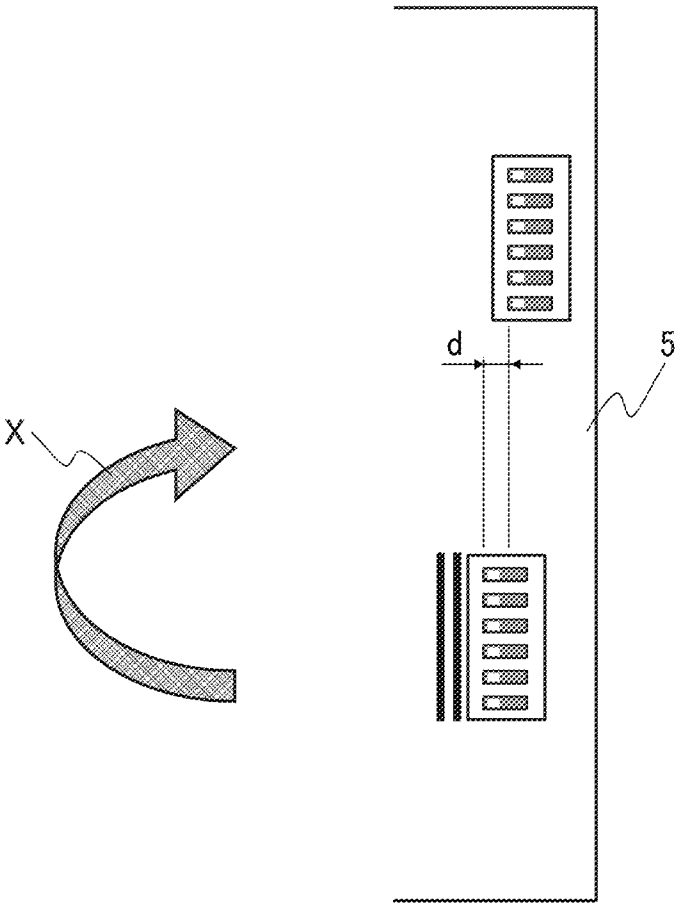
FIG. 8A is a schematic diagram illustrating bound portions of a comparative example.

With reference to FIGS. 8A, and 8B, an issue when the binding unit 310 executes binding processes at a plurality of positions is described. As illustrated, the binding teeth 322 according to the present embodiment executes one binding process at one binding position to form bound portions aligning to form a rectangular shape having a long side along an end side of the sheet bundle 5 that is a bound target. The number of bound portions formed by one binding process is six.

The binding unit 310 according to the present embodiment executes the binding processes at two adjacent binding positions in one binding job. Accordingly, the binding unit 310 according to the present embodiment forms twelve bound portions in one binding job.

As illustrated in FIG. 8A, a misalignment d may occur between an imaginary straight line combining ends in the longitudinal direction of the six bound portions formed by the first binding process and an imaginary straight line combining ends in the longitudinal direction of the six bound portions formed by the second binding process. When the sheet 4 in the sheet bundle 5 is turned over in a direction illustrated by a curved arrow X in FIG. 8A, the misalignment d causes concentration of a load at bound portions formed by one binding process. In the case illustrated in FIG. 8A, the load concentrates on the bound portions far from the end of the sheet bundle 5. Therefore, the binding force is given by the six bound portions, not by the twelve bound portions. That is, the misalignment d reduces the binding force. Since only the six bound portions receive the load, the sheet bundle in which two binding processes are executed has the same binding force as the sheet bundle in which one binding process is executed, and as a result the sheet 4 is easily peeled away from the sheet bundle 5, that is, the binding state is easily broken.

On the other hand, as illustrated in FIG. 8B, when the bound portion formed by the first binding process and the bound portion formed by the second binding process are lined up so that the misalignment d caused by the two imaginary straight lines is zero or nearly zero, the twelve bound portions receive the load when the sheet 4 in the sheet bundle 5 is turned over in a direction illustrated by the curved arrow X in FIG. 8B. In addition, forming the six bound portions in the second binding process at the binding position slightly separated from the binding position of the first binding process that forms the six bound portions widens an area under the load and gives a stronger binding force.

Therefore, in the post-processing apparatus 3 that executes the non-staple binding processes, the controller 61 preferably executes a plurality of binding processes on one sheet bundle 5 so that the misalignment d between the imaginary straight lines combining the ends in the longitudinal direction of the bound portions formed by a plurality of binding processes is zero or nearly zero.

Figure 9:
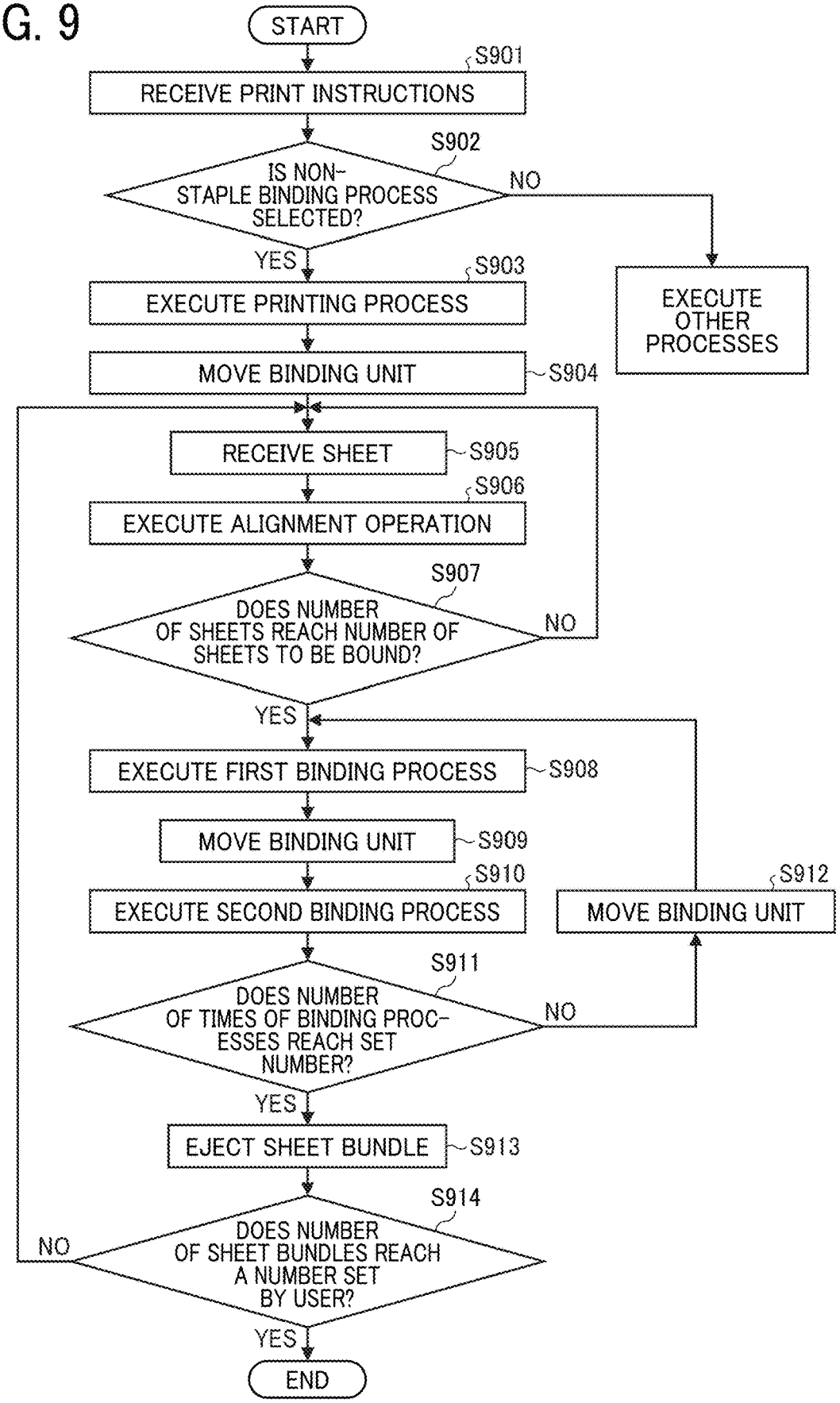
FIG. 9 is a flow chart illustrating operations of the image forming system according to the present disclosure.
Figure 10:
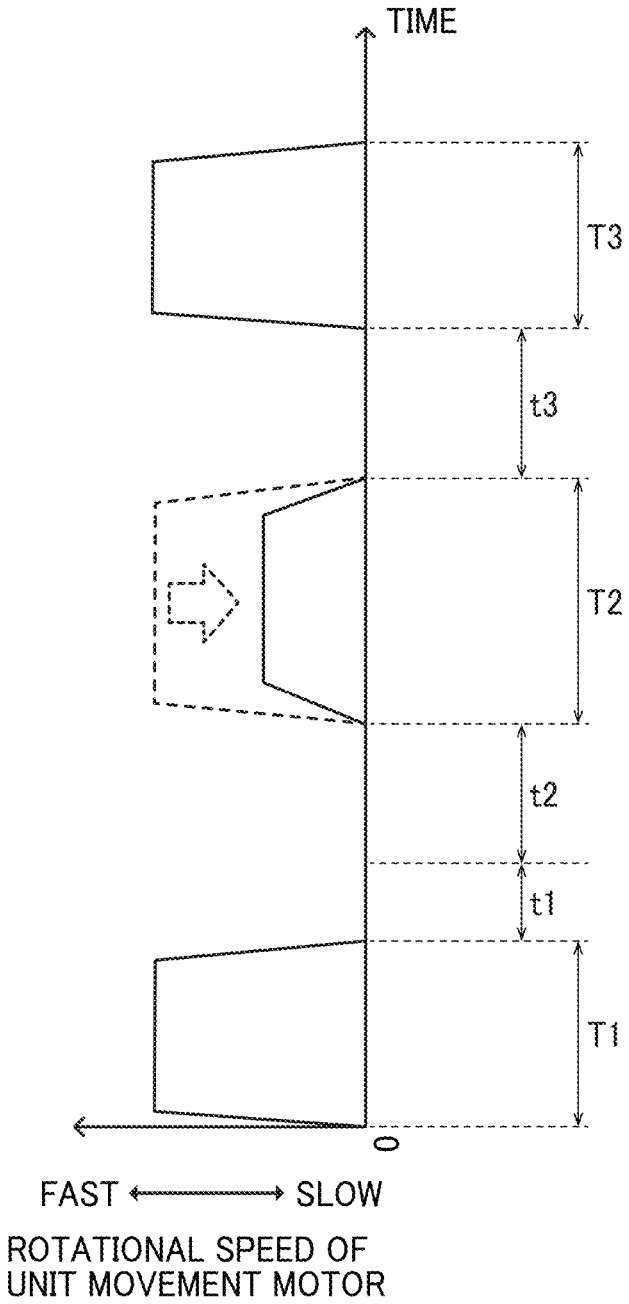
FIG. 10 is a timing chart illustrating a movement control of the binding unit according to the present disclosure.

Using the flow chart in FIG. 9 and the timing chart in FIG. 10, operational control of the binding device 300 to align the bound portions formed by a plurality of binding processes as illustrated in FIG. 8B is described. FIGS. 9 and 10 illustrate the operational control of the binding device 300 according to the present embodiment.

FIG. 9 illustrates an entire flow of processes in the image forming system 1 and is the flowchart illustrating processes in a finisher from the start of the print job to the completion of the sheet ejection in the print job set by a user. The non-staple binding processes according to the present embodiment correspond to a part of the processes in FIG. 9.

First, the user turns on the printer 2 and sets print modes, that is, selects settings for a print product printed on a recording medium or recording media, such as setting one sided print or double-sided print and setting a gathering process, a stapling process, and a punching process. The printer 2 receives a print instruction in accordance with the set print modes in step S901. Receiving the print instruction, the printer 2 determines whether the non-staple binding processes are selected in the set print modes in step S902. When the non-staple binding processes are not selected, that is, no in step S902, the printer executes the print instruction based on the set print modes and executes other processes.

When the non-staple binding processes are selected, that is, yes in step S902, the printer 2 executes a printing process in step S903 based on conditions set by the user. After execution of the printing process, the binding unit 310 in the binding device 300 moves to execute the non-staple binding processes according to the set sheet size condition in step S904. The movement at this time is a movement corresponding to a section M1 illustrated in FIG. 7. As described with reference to FIG. 6, the post-processing apparatus 3 receives the sheets 4, forms the sheet bundle 5 in step S905, and executes the alignment operation for the sheet bundle 5 in step S906.

The post-processing apparatus 3 receives setting data about the print product from the printer 2 and determines whether number of sheets 4 received reaches number of sheets to be bound based on the setting data in step S907. When the number of sheets 4 does not reach the number of sheets to be bound, that is, no in step S907, the post-processing apparatus 3 continues to receive the sheet 4 in step S905.

When the number of sheets reaches the number of sheets to be bound, that is, yes in step S907, the second driver drives so that the binding teeth 322 works, and the binding unit 310 executes the first binding process in step S908 because the movement of the section M1 illustrated in FIG. 7 already moves the binding unit 310 to the first stop position in step S904.

Subsequently, in step S909, the binding unit 310, that is, the binding teeth 322 moves to the second stop position P2 at which the binding unit 310 executes the second binding process. The movement at this time is a movement corresponding to a section M2 illustrated in FIG. 7. Then, the second driver drives again so that the binding teeth 322 works, and the binding unit 310 executes the second binding process in step S910. Thereafter, the controller determines whether the number of times of binding processes reaches a set number in step S911.

When the number of times of binding processes does not reach the set number, that is, no in step S911, the unit movement motor 304 as the first driver is driven to move the binding unit 310 to the next binding position (for example, P3 in FIG. 7) in step S912. Then, the binding unit 310 executes the binding process again in step S908.

When the number of times of binding processes reaches the set number, that is, yes in step S911, the first movable reference fence, the conveyance rollers 13, and the sheet ejection rollers 14 eject the bound sheet bundle 5 to the output tray 10 in step S913. Thereafter, the controller determines whether number of the sheet bundles reaches number of sheet bundles set by the user in step S914. When the number of the sheet bundles does not reach the set number of sheet bundles, that is, no in step S914, the controller returns the process to receive the sheet in step S905, and the post-processing apparatus 3 repeats processes from step S905 to receive the sheet to step S913 to eject the sheet bundle until the number of the sheet bundles reaches the set number of sheet bundles. When the number of the sheet bundles reaches the set number of sheet bundles, that is, yes in step S914, the controller completes the processes.

Movement control of the binding unit 310 in the binding device 300 is included in the operation flow described above. The movement control is described below with reference to the timing chart in FIG. 10.

The timing chart in FIG. 10 illustrates an example of change in the rotational speed of the unit movement motor 304 that corresponds to the movement speed of the binding unit 310 illustrated in FIG. 7. The movement speeds of the binding unit 310 in the movement sections M1, M2, and M3 illustrated in FIG. 7 correspond to the rotational speeds of the unit movement motor 304 in times T1, T2, and T3 illustrated in FIG. 10 that are examples of times for which the binding unit 310 moves in the movement sections.

When the binding unit 310 moves in step S904 illustrated in the flowchart of FIG. 9, that is, when the binding unit 310 moves from the home position P0 to the first stop position P1, the controller controls the unit movement motor 304 to increase the rotational speed. In other words, the controller controls the unit movement motor 304 to rotate faster during the time T1 corresponding to the movement time in the movement section M1. This quickly completes the movement of the binding unit 310 to the position at which the binding unit 310 starts the binding process. When the movement in the movement section M1 is completed, the unit movement motor 304 stops rotation to stop the binding unit 310. Therefore, the rotational speed of the unit movement motor 304 becomes zero.

Since the binding unit 310 reaches a stage to execute the first binding process, the binding unit 310 waits on standby for a time t1 that is the time until the post-processing apparatus 3 completes receiving the sheets for the sheet bundle, that is, steps from step S905 to step S907.

After the post-processing apparatus 3 completes receiving the sheets for the sheet bundle, the second driver works to drive the binding teeth 322, and the binding unit 310 executes the first binding process in step S908. During a time t2 for the first binding process, the rotational speed of the unit movement motor 304 remains zero because the unit movement motor 304 does not move the binding unit 310.

After the first binding process, the binding unit 310 moves to the second binding position that is the second stop position P2. Therefore, the unit movement motor 304 rotates again to move the binding unit 310 to the second stop position P2. During the time T2 corresponding to the movement time in the movement section M2, the controller controls the unit movement motor 304 to rotate at a slower speed than the speed during the time T1 corresponding to the movement time in the movement section M1. This enables the binding unit 310 to accurately stop at the second stop position for the second binding process and improves an alignment accuracy between the bound portions formed by the first binding process and the bound portions formed by the second binding process.

The controller 61 controls the rotational speeds of the unit movement motor 304 including the rotational speed during the time T1 that defines the first movement speed and the rotational speed during the time T2 that defines the second movement speed. Therefore, the controller 61 controls the first driver so that the second movement speed is slower than the first movement speed.

After the binding unit 310 moves to the second stop position, the binding unit 310 executes the second binding process during a time t3. During the time t3, the unit movement motor 304 does not rotate. After the second binding process, the controller 61 controls the unit movement motor 304 to either move the binding unit 310 to the next binding position or return the binding unit 310 to the home position P0.

As described above, in the binding unit 310 according to the present embodiment, the controller 61 controls the rotational speed of the unit movement motor 304 as the first driver so that the second movement speed from the first binding position to the second binding position is slower than the first movement speed to the first binding position. This control prevents the stop position of the binding unit 310 from being shifted by moment of inertia when the binding unit 310 in the binding device 300 moves from the first binding position to the second binding position. That is, the binding device 300 can align a plurality of binding positions with high accuracy, and a quick movement of the binding unit 310 before the first binding process and after the second binding process improves the efficiency of the binding processes.

Next, a description is given of the post-processing apparatus according to a second embodiment of the present disclosure.

Figure 11:
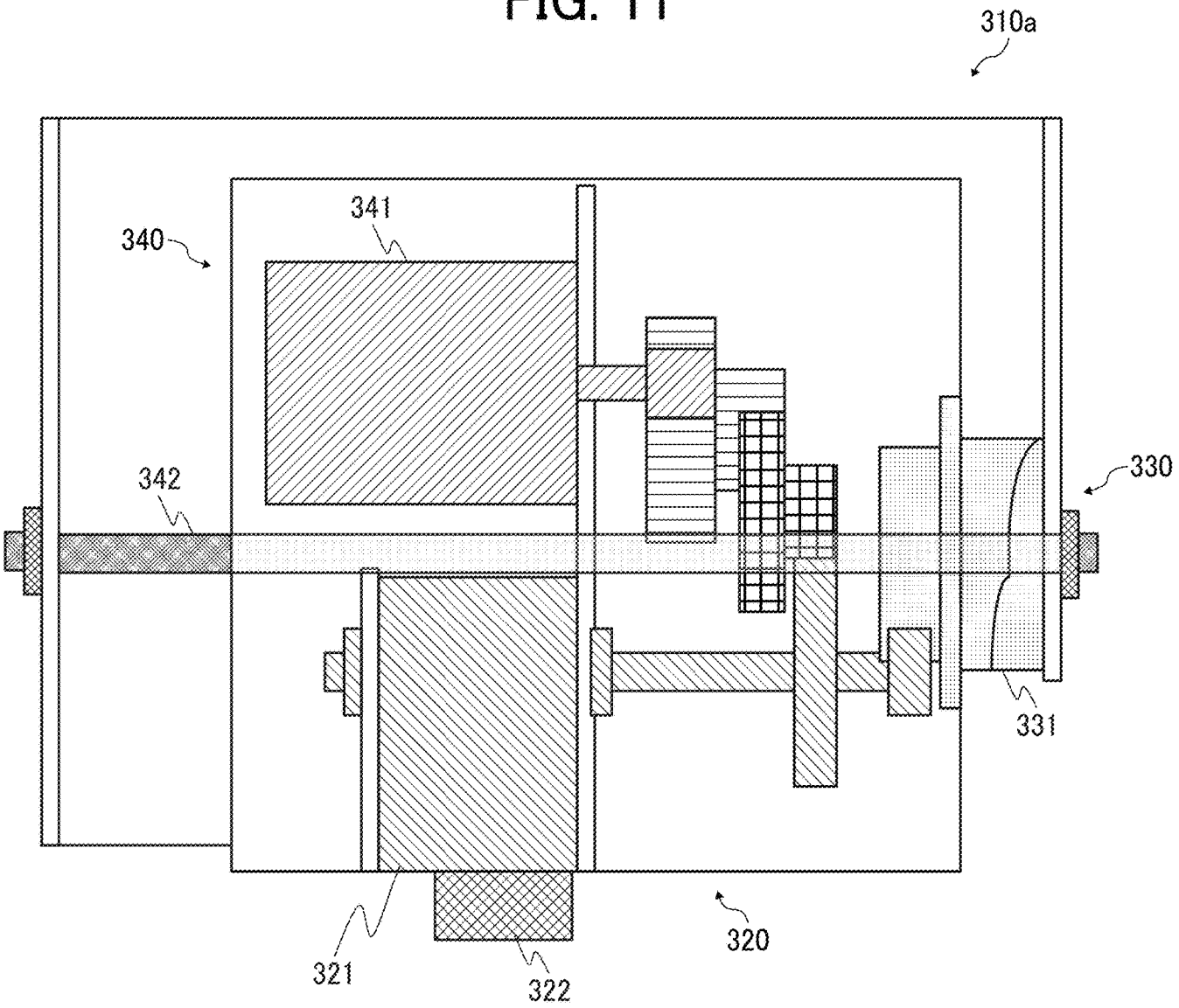
FIG. 11 is a schematic diagram illustrating a configuration of the binding unit in the post-processing apparatus according to a second embodiment.

FIG. 11 is a diagram illustrating an internal structure of a binding unit 310*a* of the binding device according to the second embodiment. As illustrated in FIG. 11, the binding unit 310*a* includes a clamping unit 320, a clamping unit movement controller 330, and a unit driver 340.

The clamping unit 320 includes a clamping controller 321 that operates the binding teeth 322 used in the binding processes that are clamping processes on the sheet bundle 5.

The clamping unit movement controller 330 includes a cam 331 that generates a driving force to move the clamping unit 320 and a transmission mechanism that transmits the driving force generated by the cam 331 to the clamping unit 320. The cam 331 generates the driving force corresponding to the rotational speed of the drive motor 341. The driving force generated by the cam 331 drives the binding teeth 322 to generate the pressing force in the binding processes. Additionally, the driving force generated by the cam 331 changes the position of the clamping unit 320 via the transmission mechanism. This results in a movement of the clamping unit 320 along a unit movement shaft 342 in an axial direction. Each time the cam 331 rotates once, the binding teeth 322 executes one cycle of operations, that is, the binding operation, movement, binding operation, and movement, in this order. That is, one rotation of the cam 331 causes two binding operations of the binding teeth 322.

The unit driver 340 includes a drive motor 341 as the second driver, a transmission mechanism that transmits the driving force of the drive motor 341 to the cam 331, and the unit movement shaft 342 to guide the movement of the clamping unit 320.

The drive motor 341 rotates and generates a driving force, and the transmission mechanism transmits the driving force to the cam 331. The driving force from the unit driver 340 rotates the cam 331. Since the rotation of the cam 331 moves the clamping unit 320, the rotational speed of the drive motor 341 determines a speed of a movement of the clamping unit 320 and a speed of the binding operations by the binding teeth 322.

The drive motor 341 is, for example, an electric motor.

Therefore, the speed of the movement of the clamping unit 320 depends on the rotational speed of the drive motor 341. The binding force determined by the pressing force of the binding teeth 322 also depends on the rotational speed of the drive motor 341. In the binding unit 310*a* according to the present embodiment, the same driver such as the drive motor 341 moves the clamping unit 320 and drives the operations of the binding teeth 322.

Next, the operations of the binding unit 310*a* are described with reference to FIGS. 12 and 13.

Figure 12:
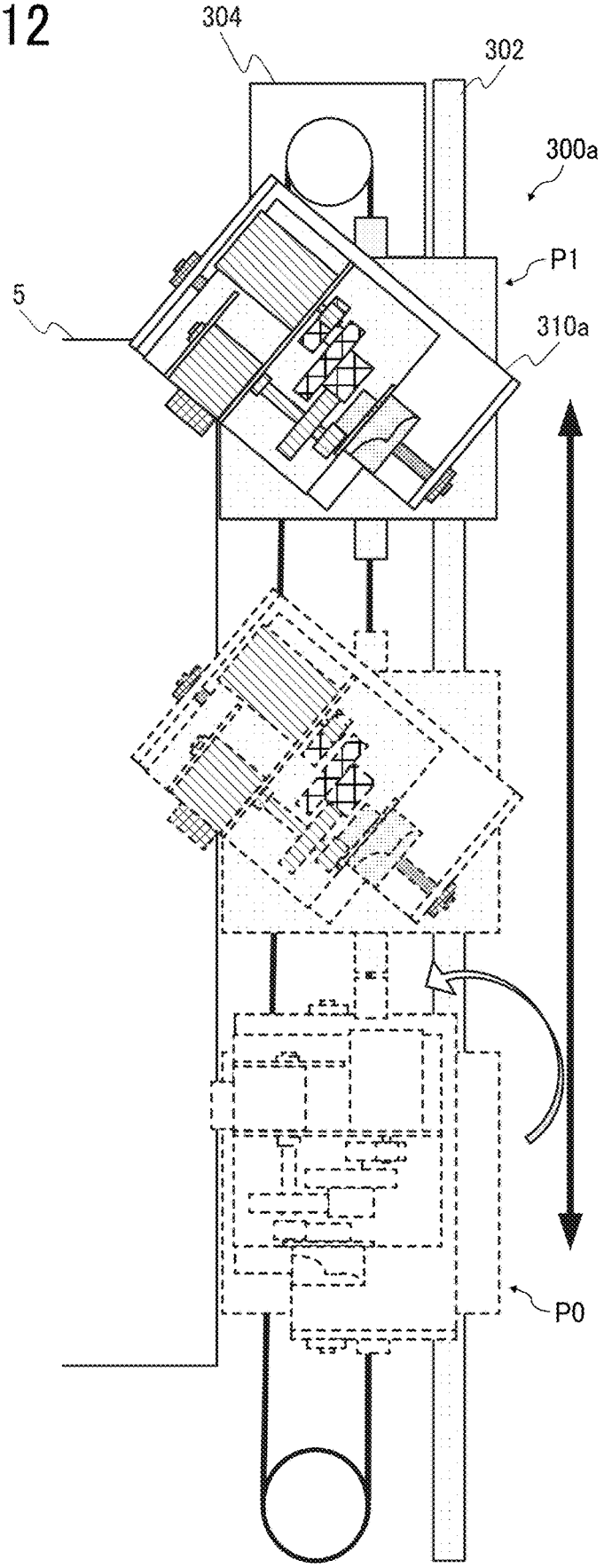
FIG. 12 is an explanatory diagram illustrating operations of the binding unit in the post-processing apparatus according to the second embodiment.

As illustrated in FIG. 12, the driving force of the unit movement motor 304 as the first driver moves the binding unit 310*a* in the binding device 300*a* according to the present embodiment from the home position P0 to the first stop position P1 for the first binding process. During the movement of the binding unit 310*a*, or after the binding unit 310*a* stops at the first stop position P1 to execute the first binding process, the binding unit 310*a* pivots with respect to the sheet bundle 5 and adopts a posture inclined with respect to the side of the sheet bundle 5.

Figure 13A:
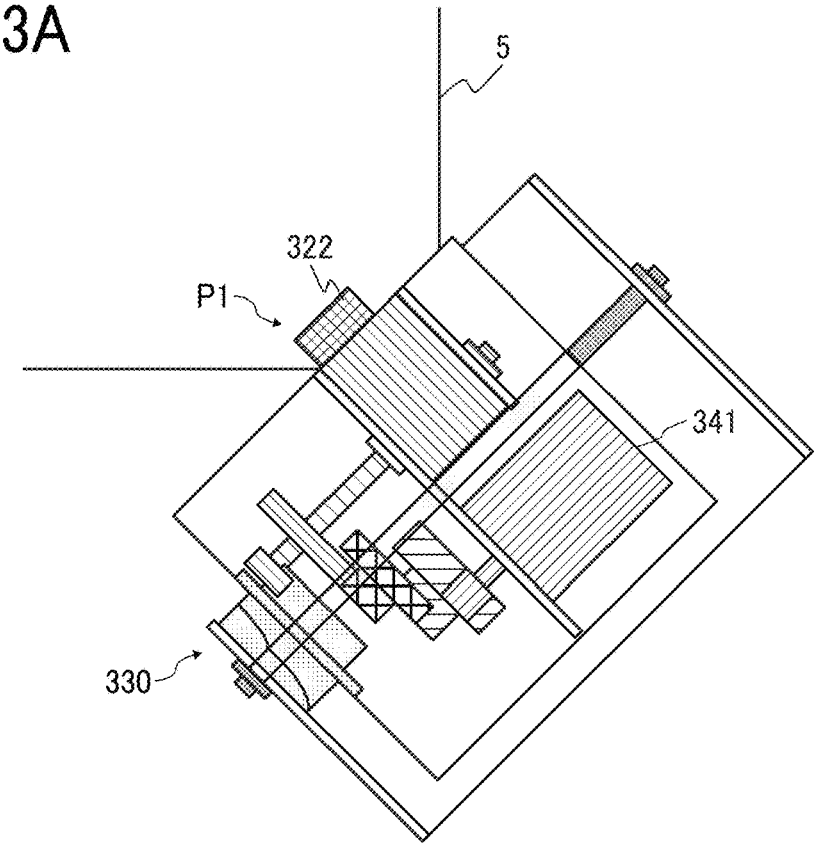
FIGS. 13A and 13B are explanatory diagrams illustrating the operations of the binding unit according to the second embodiment.

As illustrated in FIG. 13A, after moving to the first stop position P1 to execute the first binding process, the position P1 that is at a corner of the sheet bundle 5, the binding unit 310*a* executes the first binding process on a corner portion of the sheet bundle 5. In the first binding process, rotation of the drive motor 341 rotates the cam 331, and the rotation of the cam 331 causes the binding operation of the binding teeth 322. The rotational speed of the drive motor 341 in the binding operation is referred to as a first rotation speed. The first rotation speed is a fast speed to increase the pressing force of the binding teeth 322 to maintain the binding force to some extent.

Figure 13B:
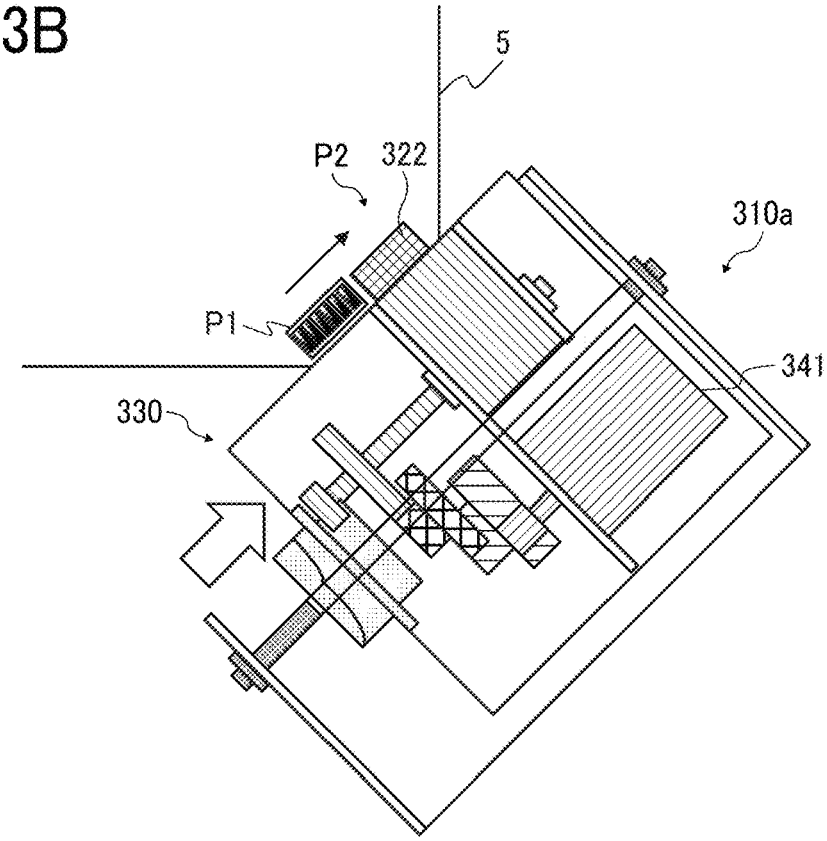

Next, as illustrated in FIG. 13B, in the binding unit 310*a*, the rotation of the drive motor 341 further rotates the cam 331, and the rotation of the cam 331 moves the clamping unit 320 to the second stop position P2 that is the second binding position. Additionally, the drive motor further rotates the cam 331, and the binding unit 310*a* executes the binding operation of the binding teeth 322. The rotational speed of the drive motor 341 when the clamping unit 320 moves is referred to as a second rotation speed.

As already described, the rotational speed of the cam 331 depends on the rotational speed of the drive motor 341. The rotation of the cam 331 causes the movement of the clamping unit 320 and the binding operations of the binding teeth 322. For example, rotating the cam 331 by 45 degrees causes one binding operation of the binding teeth 322, and subsequently rotating the cam 331 by 45 degrees causes the movement of the clamping unit 320 from the first stop position P1 to the second stop position P2. Then, the cam 331 further rotates 45 degrees to execute one binding operation. Additionally, further rotating the cam 331 by 45 degrees causes the movement of the clamping unit 320 from the second stop position P2 to the first stop position P1. That is, in the binding unit 310*a*, one drive motor 341 drives the binding teeth 322 and the cam 331, and rotations of the drive motor 341 in one direction causes repetition of the binding process and the movement.

A first example of a rotational speed control of the drive motor 341 in the binding unit 310*a* is described in detail.

Figure 14A:
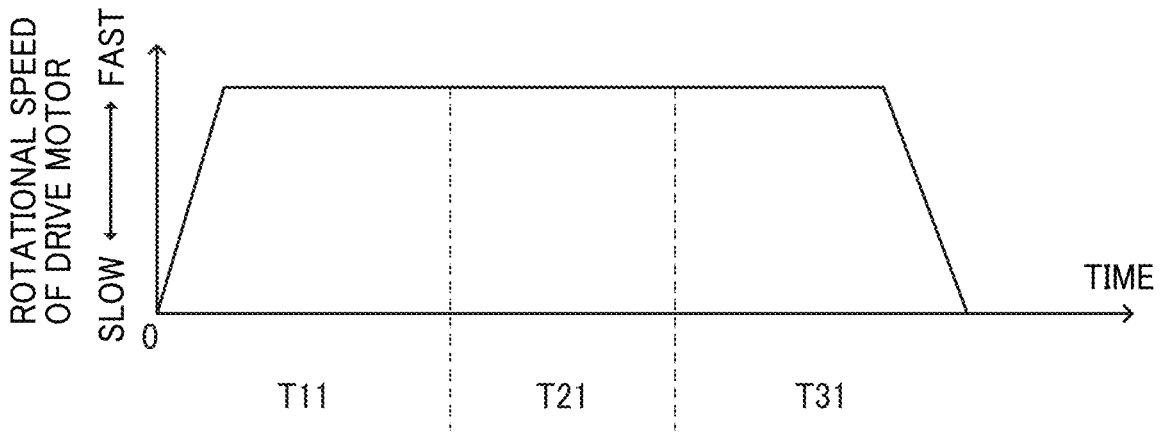
FIG. 14A is a timing chart illustrating a comparative example of a rotational speed control of a drive motor in the binding unit.
Figure 14B:
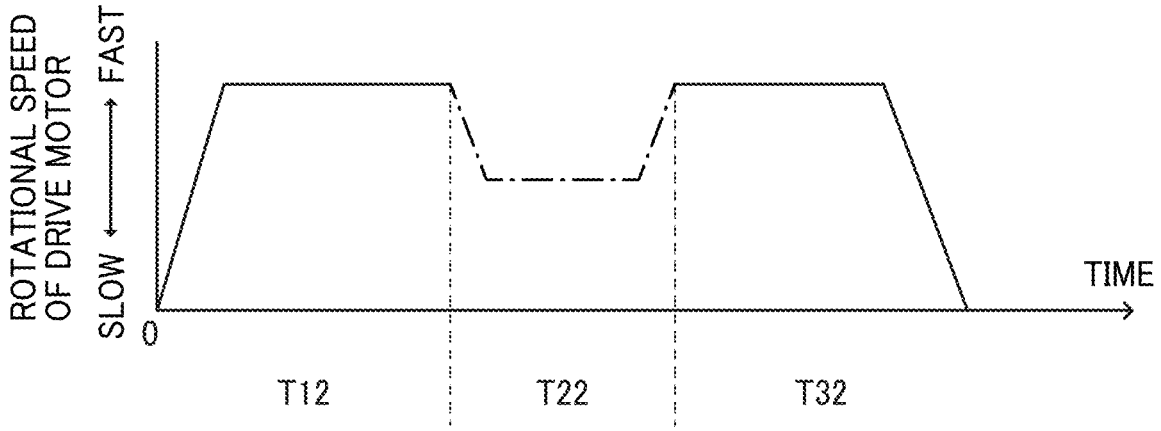
FIG. 14B is a timing chart illustrating an example of a rotational speed control of the drive motor according to the second embodiment.

FIG. 14A is a timing chart illustrating a comparative example of the rotational speed control of the drive motor 341. FIG. 14B is a timing chart illustrating an example of a rotational speed control of the drive motor 341 according to the second embodiment;

In the comparative example, from the first binding process to the second binding process, the rotational speed of the drive motor 341 is the same as the rotational speed of the drive motor 341 for a time T11 while the binding unit 310*a* stopping at the first stop position P1 executes the first binding process.

When the binding unit 310*a* binds a plurality of positions in the sheet bundle, to improve the productivity of the binding processes, that is, the efficiency of the binding processes, increasing the speed of the movement of the binding unit 310*a* moved by the drive motor 341 is preferable. However, when the drive motor 341 increases the speed of the movement, the binding unit 310*a* vibrates due to inertia from the weight of the binding unit 310*a* itself or load fluctuation caused by higher binding speed, which causes the misalignment between the first binding position and the second binding position.

In the binding unit 310*a* according to the present embodiment, as illustrated in FIG. 14B, during a time T12 from the start of the binding processes to the end of the first binding process, the rotational speed of the drive motor 341 is set the fast speed that is the same as the rotational speed of the drive motor 341 in the comparative example. This secures the pressing force of the binding teeth 322 in the first binding process.

The movement of the binding unit 310*a* to the second stop position P2 to execute the second binding process after the first binding process needs to be controlled with high accuracy to secure the binding force. Therefore, the rotational speed of the drive motor 341 when the binding unit 310*a* moves from the first stop position P1 to the second stop position P2 is set slower than that while the binding teeth 322 executes the binding operation.

In the binding unit 310*a* according to the present embodiment, the controller controls the drive motor 341 so that the rotational speed of the drive motor while the binding teeth 322 executes the binding operation differs from the rotational speed of the drive motor 341 when the binding unit 310*a* moves. In the binding unit 310*a*, a driving force that drives the binding teeth 322 when the rotational speed of the drive motor 341 is set faster is referred to as a first driving force. In addition, a driving force that moves the binding teeth 322 when the rotational speed of the drive motor 341 is set slow is referred to as a second driving force.

More specifically, the controller controls the drive motor so that the second rotation speed that is the rotational speed when the binding teeth 322 moves is slower than the first rotation speed in the binding operation. In other words, the second driving force is controlled to be smaller than the first driving force. This reduces vibrations that occur in the binding unit 310*a* during the movement from the first binding position to the second binding position, which improves accuracy for stopping the binding unit 310*a* at the second stop position P2. Improving the accuracy for stopping the binding unit 310*a* improves the accuracy for aligning bound portions formed by the plurality of binding processes and secures the binding force.

Next, a second example of the rotational speed control of the drive motor 341 in the binding unit 310*a* is described in detail.

Figure 15:
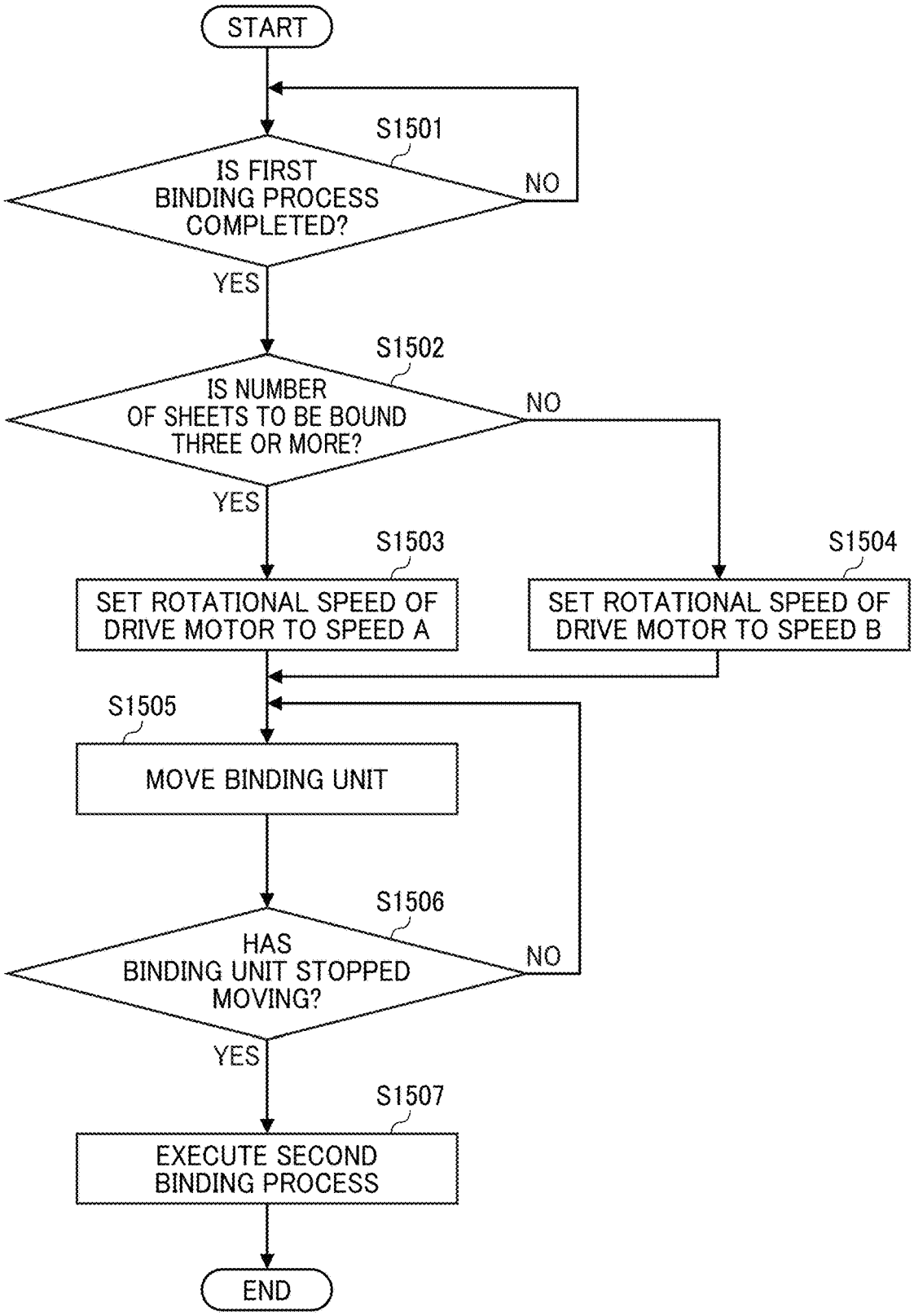
FIG. 15 is a flow chart illustrating another example of the rotational speed control of the drive motor in which a controller changes the rotational speed based on number of sheets.

FIG. 15 is a flow chart illustrating the second example of the rotational speed control of the drive motor 341 in the binding unit 310*a*.

When the binding unit 310*a* starts the binding processes, the controller 61 controls the unit movement motor 304 to move the binding unit 310*a* to the first binding position. Until the binding unit 310*a* completes the first binding process at the first binding position, the drive motor 341 continues to rotate at a predetermined speed that is a high speed, that is, no in step S1501.

When the binding unit 310*a* completes the first binding process, that is, yes in step S1501, the controller 61 determines whether number of stacked sheets 4, that is, the number of sheets to be bound in the sheet bundle 5 to be bound in the current binding processes is greater than a predetermined number in step S1502. For example, in the present embodiment, the controller 61 determines that the number of sheets to be bound is small when the number of sheets is less than 3 and determines that the number of sheets to be bound is large when the number of sheets is 3 or more.

The smaller the number of sheets to be bound is, the smaller the amount of fibers entangled with a single press by the binding teeth 322 is. Therefore, the small number of sheets to be bound weakens the binding force in one binding process. In contrast, the larger the number of sheets to be bound is, the larger the amount of fibers entangled with a single press by the binding teeth 322 is. Therefore, the large number of sheets to be bound strengthens the binding force in one binding process.

Therefore, when the number of sheets to be bound is large, that is, yes in step S1502, the controller 61 controls the drive motor 341 to decrease the rotational speed by a small amount, that is, decrease the driving force by a small amount because the binding force can be secured even if the accuracy of the alignment between the first binding position and the second binding position decrease. In step S1503, the controller 61 sets the rotational speed of the drive motor 341 in this case to the rotation speed A that is the first rotation speed.

In contrast, when the number of sheets to be bound is small, that is, no in step S1502, the controller 61 controls the drive motor 341 to decrease the rotational speed by a large amount, that is, decrease the driving force by a large amount and slow down the speed of the movement from the first binding position to the second binding position to improve the accuracy of the alignment between the first binding position and the second binding position and secure the binding force. In step S1504, the controller 61 sets the rotational speed of the drive motor 341 in this case to the rotation speed B that is the second rotation speed.

Subsequently, the controller 61 controls the drive motor 341 to rotate at the set rotational speed in step S1505 and move the clamping unit 320 to the second stop position P2 at which the binding teeth 322 executes the second binding process, that is, no in step S1506. When the clamping unit 320 moves to the second stop position P2, the movement of the binding teeth 322 stops, that is, yes in step S1506.

Subsequently, the controller 61 controls the drive motor 341 to increase the rotational speed of the drive motor 341 to the rotation speed A for the binding process and execute the second binding process in step S1507. As described above, the controller executes the operational control of the binding processes in the binding unit 310*a*.

Next, a third example of the rotational speed control of the drive motor 341 in the binding unit 310*a* is described in detail.

Figure 16:
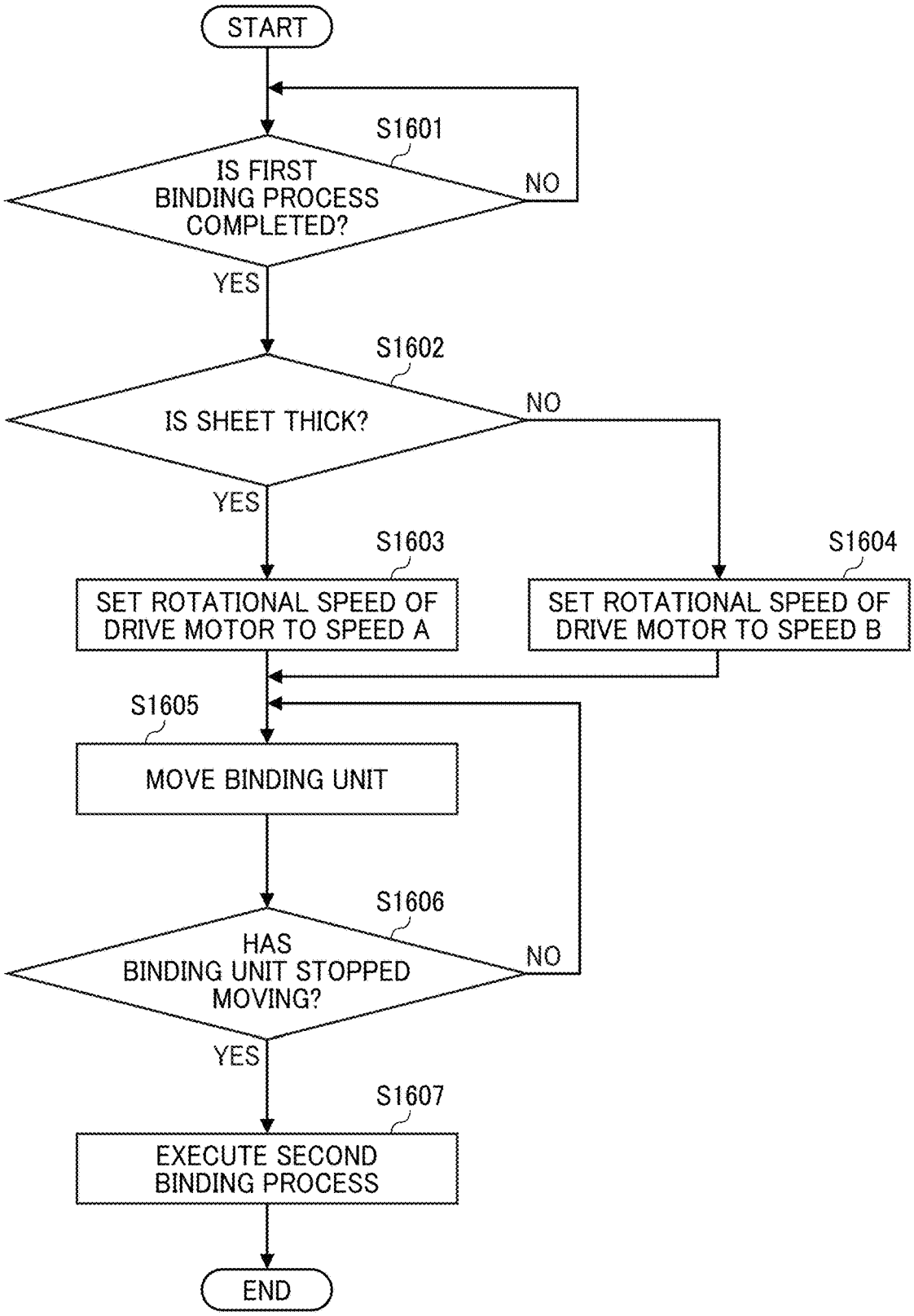
FIG. 16 is a flow chart illustrating another example of the rotational speed control of the drive motor in which the controller changes the rotational speed based on a thickness of the sheet.

FIG. 16 is a flow chart illustrating the third example of the rotational speed control of the drive motor 341 in the binding unit 310*a*.

When the binding unit 310*a* starts the binding processes, the controller 61 controls the unit movement motor 304 to move the binding unit 310*a* to the first binding position. Until the binding unit 310*a* completes the first binding process at the first binding position, the drive motor 341 continues to rotate at a predetermined speed that is the high speed, that is, no in step S1601.

When the binding unit 310*a* completes the first binding process, that is, yes in step S1601, the controller 61 determines whether a thickness of the sheet 4 in the sheet bundle 5 to be bound in the current binding processes is greater than a predetermined thickness in step S1602. For example, in the present embodiment, the controller 61 determines that the sheet 4 is thick when the user sets that the sheet 4 is a thick sheet in a control panel of the image forming apparatus and determines that the sheet 4 is thin when the user sets that the sheet 4 is a thin sheet in the control panel.

The thinner the sheet 4 is, the smaller the amount of fibers entangled with a single press by the binding teeth 322 is. Therefore, in the thin sheet, the binding force in one binding process is weak. In contrast, in the thick sheet, the binding force is strong because the amount of fibers entangled with a single press by the binding teeth 322 is large.

Therefore, when the sheet 4 is the thick sheet, that is, yes in step S1602, the controller 61 controls the drive motor 341 to decrease the rotational speed by a small amount, that is, decrease the driving force by a small amount because the binding force can be secured even if the accuracy of the alignment between the first binding position and the second binding position decrease. In step S1603, the controller 61 sets the rotational speed of the drive motor 341 in this case as the rotation speed A that is the first rotation speed.

In contrast, when the sheet 4 is the thin sheet, that is, no in step S1602, the controller 61 controls the drive motor 341 to decrease the rotational speed by a large amount, that is, decrease the driving force by a large amount and slow down the speed of the movement from the first binding position to the second binding position to improve the accuracy of the alignment between the first binding position and the second binding position and secure the binding force. In step S1604, the controller 61 sets the rotational speed of the drive motor 341 in this case as the rotation speed B that is the second rotation speed.

Subsequently, the controller 61 controls the drive motor 341 to rotate at the set rotational speed in step S1605 and move the clamping unit 320 to the second stop position P2 at which the binding teeth 322 executes the second binding process, that is, no in step S1606. When the clamping unit 320 arrives at the second stop position P2, the movement of the binding teeth 322 stops, that is, yes in step S1606.

Subsequently, the controller 61 controls the drive motor 341 to increase the rotational speed of the drive motor 341 to the rotation speed A for the binding process and execute the second binding process in step S1607. As described above, the controller executes the operational control of the binding processes in the binding unit 310*a*.

Next, a fourth example of the rotational speed control of the drive motor 341 in the binding unit 310*a* is described in detail.

Figure 17:
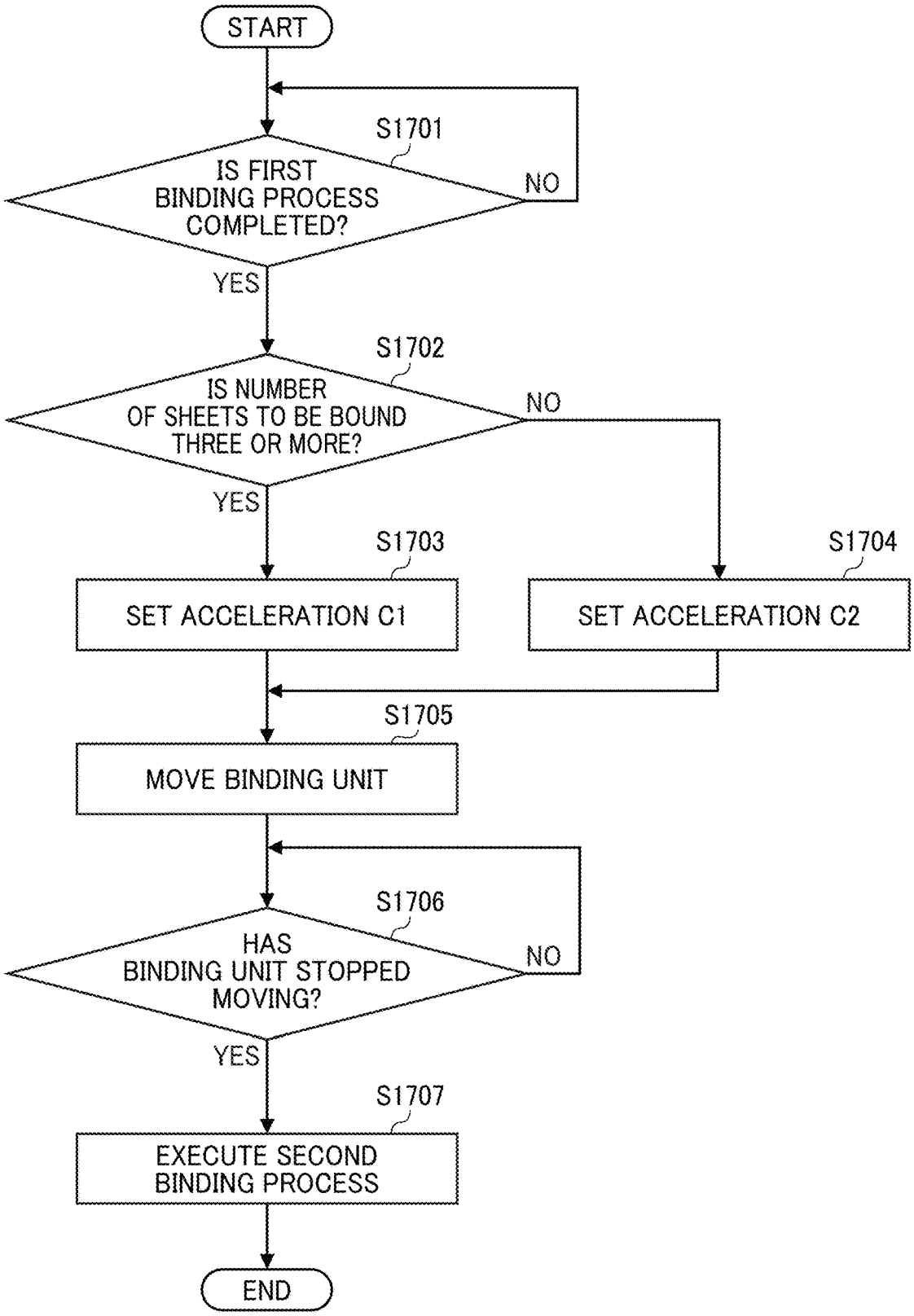
FIG. 17 is a flow chart illustrating another example of the rotational speed control of the drive motor in which the controller changes acceleration to change the rotational speed based on the number of sheets.

FIG. 17 is a flow chart illustrating the fourth example of the rotational speed control of the drive motor 341 in the binding unit 310*a*.

When the binding unit 310*a* starts the binding processes, the controller 61 controls the unit movement motor 304 to move the binding unit 310*a* to the first binding position. Until the binding unit 310*a* completes the first binding process at the first binding position, the drive motor 341 continues to rotate at a predetermined speed that is the high speed, that is, no in step S1701.

When the binding unit 310*a* completes the first binding process, that is, yes in step S1701, in step S1702 the controller 61 determines whether number of stacked sheets 4 that is the number of sheets to be bound in the sheet bundle 5 to be bound in the current binding processes is greater than a predetermined number. For example, in the present embodiment, the controller 61 determines that the number of sheets to be bound is small when the number of sheets is less than 3 and determines that the number of sheets to be bound is large when the number of sheets is 3 or more.

The large number of sheets to be bound secures the binding force even if the accuracy of alignment between the binding positions is not high. Therefore, when the number of sheets to be bound is large, that is, yes in step S1702, the controller 61 controls the drive motor 341 to increase acceleration that is a rate at which the rotational speed of the drive motor 341 decreases and increases. This can improve the productivity of the binding processes while keeping the binding force in the sheet bundle 5. In this case, the controller 61 controls the drive motor 341 to change the rotational speed of the drive motor rapidly. In step S1703, the controller 61 sets the rotational speed of the drive motor 341 as the rotation speed A that is the first rotation speed and acceleration C1 that means a time to increase and decrease the rotational speed of the drive motor.

In contrast, when the number of sheets to be bound is small, that is, no in step S1702, the controller 61 controls the drive motor 341 to decrease the acceleration that is the rate at which the rotational speed of the drive motor 341 increases and decreases, which results in slow change of the speed of the movement from the first binding position to the second binding position. This improves the accuracy of the alignment between the binding positions and secures the binding force. In step S1704, the controller 61 also sets the rotational speed of the drive motor 341 in this case as the rotation speed A that is the first rotation speed and an acceleration C2 that means the time to increase and decrease the rotational speed of the drive motor.

Subsequently, the controller 61 controls the drive motor 341 to rotate at the set rotational speed in step S1705 and move the clamping unit 320 and the binding teeth 322 to the second stop position P2, that is, no in step S1706. When the clamping unit 320 and the binding teeth 322 moves to the second stop position P2, the controller 61 stops the movement of the clamping unit 320 and the binding teeth 322, that is, yes in step S1706.

Subsequently, the controller 61 controls the drive motor 341 to increase the rotational speed of the drive motor 341 to the rotation speed A for the binding process and execute the second binding process in step S1707. As described above, the controller executes the operational control of the binding processes in the binding unit 310*a*.

Timing charts of the second example to the fourth example are described below.

Figure 18A:
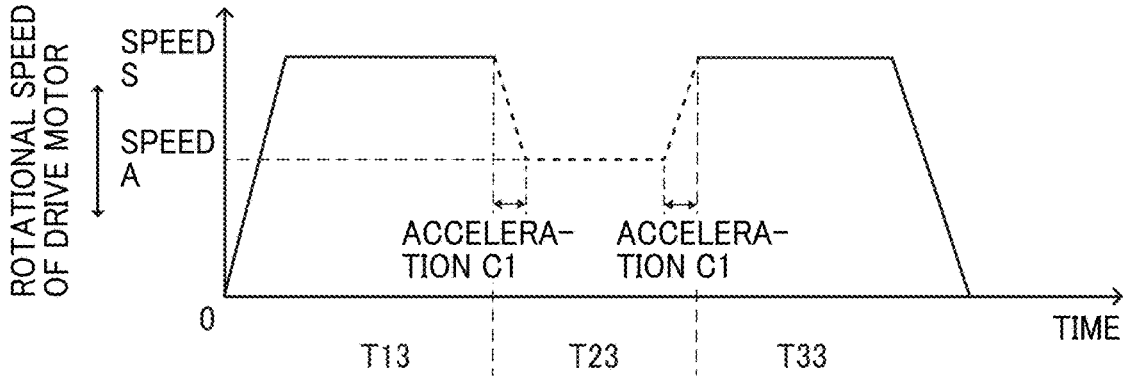
FIGS. 18A to 18C are timing charts relating to the rotational speed control of the drive motor described with reference to FIGS. 15 to 17.
Figure 18B:
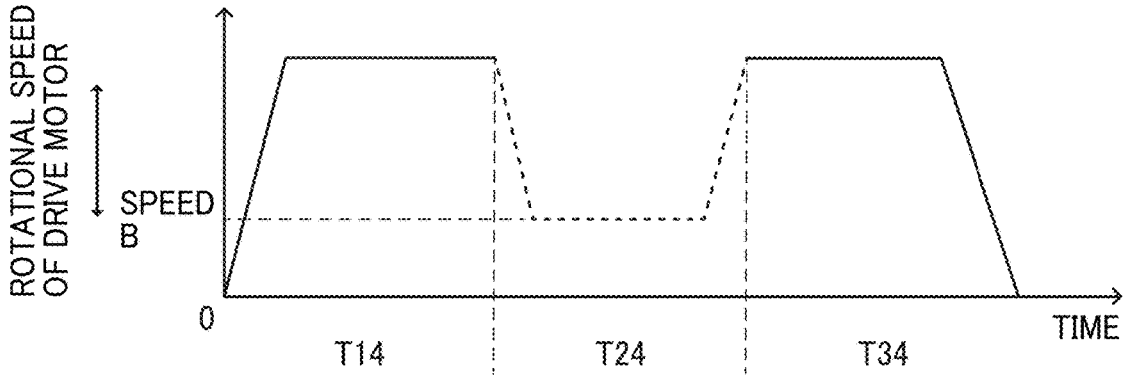
Figure 18C:
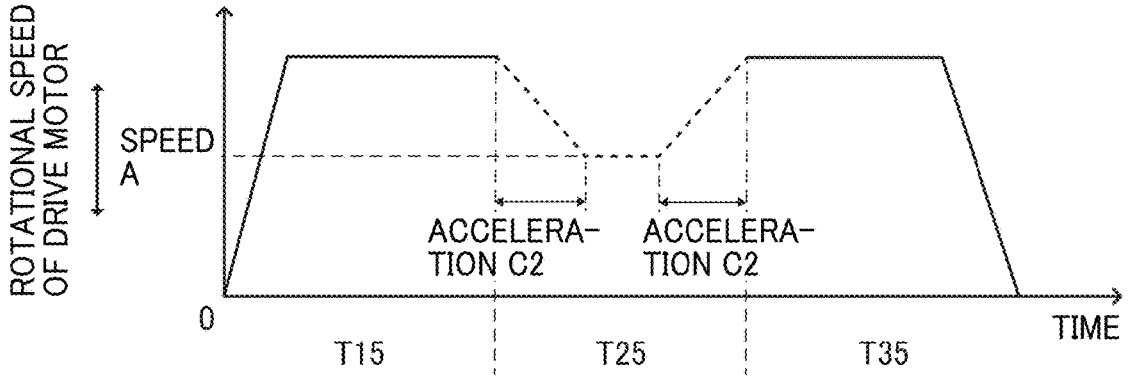

FIGS. 18A to 18C are timing charts relating to the rotational speed control of the drive motor 341 described with reference to FIGS. 15 to 17. In FIG. 18A, speed S means the rotational speed of the drive motor 341 for a time T13 in which the binding unit executes the first binding process. Additionally, in FIG. 18A, a time T23 means a time to move the binding teeth 322 to the second binding position after the first binding process, and a time T33 means a time to execute the second binding process after the binding teeth 322 moves to the second binding position.

FIG. 18A is the timing chart illustrating a case of the second example described by using the flow chart in FIG. 15, the case in which the number of sheets to be bound is 3 or more in step S1502, that is, yes in step S1502. FIG. 18B is the timing chart illustrating a case of the second example in which the number of sheets to be bound is less than 3 in step S1502, that is, no in step S1502.

FIG. 18A is also the timing chart illustrating a case of the third example described by using the flow chart in FIG. 16, the case in which the sheet 4 is thick in step S1602, that is, yes in step S1602. Similarly, FIG. 18B is the timing chart illustrating a case of the third example in which the sheet 4 is thin, that is, no in step S1602.

When the sheets to be bound are three or more in step S1702 in the fourth example described by using the flow chart in FIG. 17, that is, yes in step S1702, the controller sets the acceleration C1 as illustrated in the timing chart of FIG. 18A. In contrast, when the sheets to be bound are less than three, that is, no in step S1702, the controller sets the acceleration C2 as illustrated in the timing chart of FIG. 18C. The acceleration C2 is smaller than the acceleration C1. Therefore, when the number of sheets to be bound is small, the small acceleration when the binding teeth 322 increases and decreases the speed of the movement reduces the misalignment caused by inertia when the binding teeth 322 is stopped and weakens impact when the binding teeth 322 is stopped. This improves the accuracy of the alignment between the first binding position and the second binding position.

In the binding unit 310*a* according to the present embodiment described above, the same driver supplies the driving force to execute the binding operation of the binding teeth 322 and the driving force to move the binding teeth 322, and the driving force for the binding operation and the driving force for the movement differs. Specifically, the controller controls the drive motor 341 that is the second driver as the source of the driving force to rotate at the rotational speed for the movement slower than the rotational speed for the binding operation. The controller may increase the rotational speed for the binding process when the accuracy of the alignment between the binding positions is secured even if the rotational speed when the binding teeth 322 moves is increased to some extent.

In any cases described above, the binding unit 310*a* according to the present embodiment can efficiently execute a plurality of binding processes and secure the binding force.

Next, a fifth example of the rotational speed control of the drive motor 341 in the binding unit 310*a* is described in detail.

Figure 19:
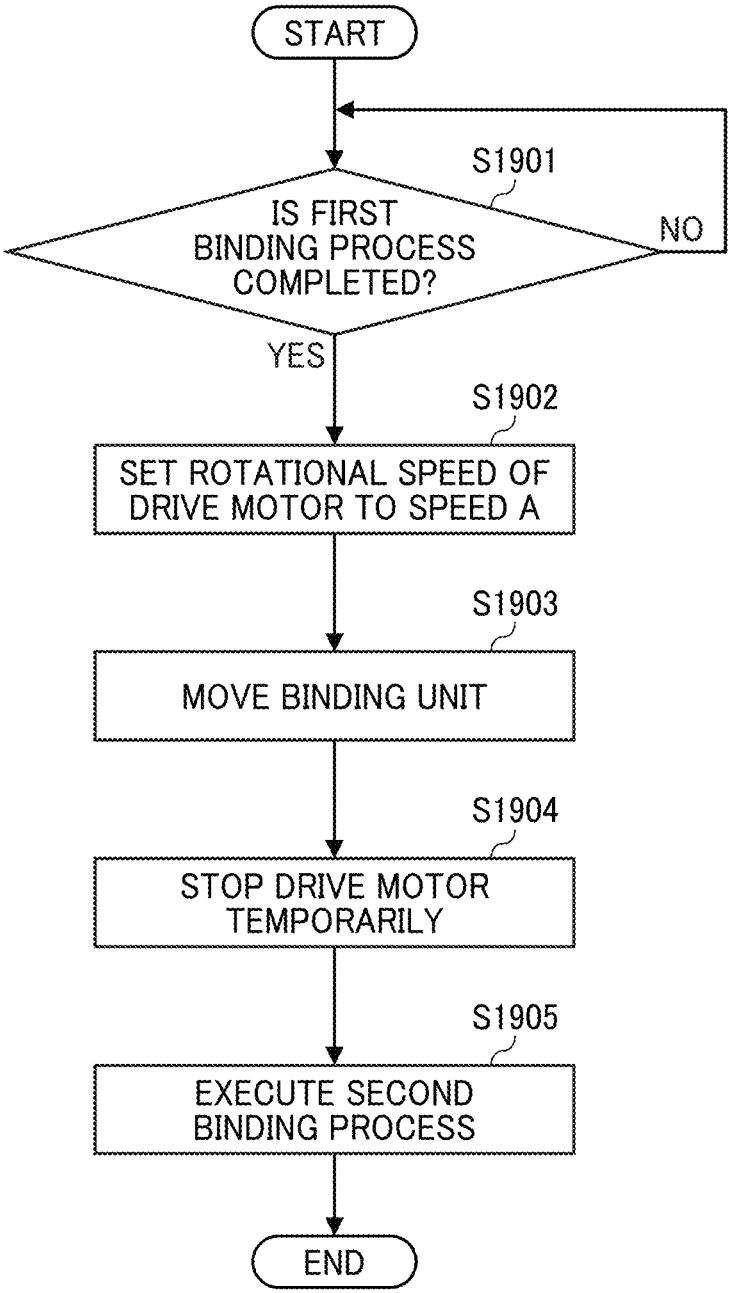
FIG. 19 is a flow chart illustrating another example of the rotational speed control of the drive motor in which the controller temporarily stops the drive motor.

FIG. 19 is a flow chart illustrating the fifth example of the rotational speed control of the drive motor 341 in the binding unit 310*a*.

When the binding unit 310*a* starts the binding processes, the controller 61 controls the unit movement motor 304 to move the binding unit 310*a* to the first binding position.

Until the binding unit 310*a* completes the first binding process at the first binding position, the drive motor 341 continues to rotate at a predetermined speed that is the high speed, that is, no in step S1901.

After the end of the first binding process, that is, yes in step S1901, the controller 61 sets the rotational speed of the drive motor 341 as the rotation speed A that is the first rotation speed in step S1902.

Subsequently, in step S1903, the controller 61 controls the drive motor 341 to rotate at the set rotational speed, move the clamping unit 320, and move the binding teeth 322 to the second stop position P2 as a predetermined position.

In step S1904, the controller stops the drive motor 341. A time to stop the drive motor in S1904 may be a time lasting until the residual vibration of the binding unit 310*a* is attenuated after the binding unit 310*a* moves and stops. When the high-speed printing process gives enough time for the binding process of the sheet bundle 5, like the present example, the drive motor 341 in the binding unit 310*a* temporarily stops supply of the first driving force. This improves the accuracy of the alignment between the binding positions formed by a plurality of binding processes and maintains the efficiency of the binding process.

After the time has passed in step S1904, the controller 61 controls the drive motor 341 to increase the rotational speed of the drive motor 341 to the rotation speed A for the binding process and execute the second binding process in step S1905.

Figure 20:
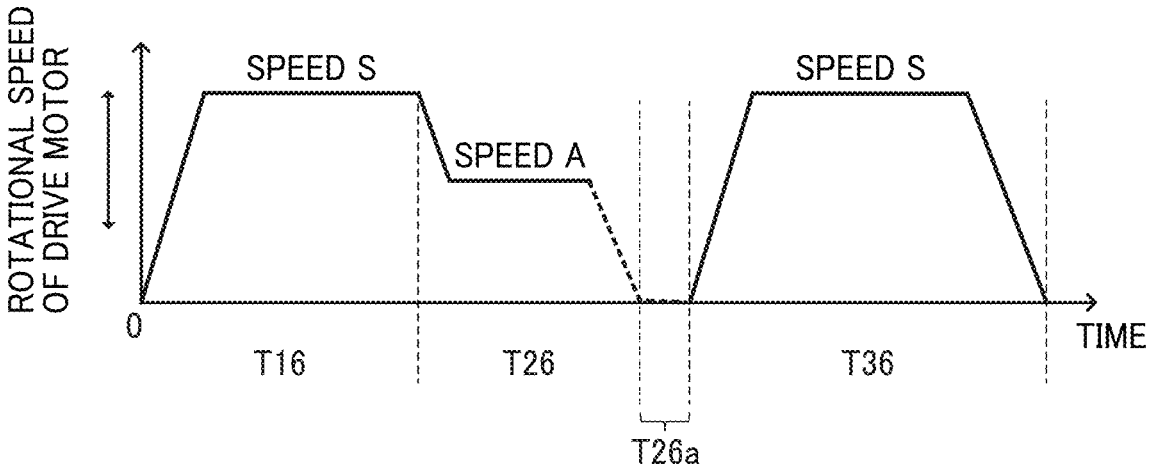
FIG. 20 is a timing chart relating to the rotational speed control of the drive motor described with reference to FIG. 19.

FIG. 20 is a timing chart relating to the rotational speed control of the drive motor 341 described with reference to FIG. 19. In FIG. 20, speed S means the rotational speed of the drive motor 341 for a time T16 in which the binding unit performs the first binding process. Additionally, in FIG. 20, a time T26 means a time to move the binding teeth 322 to the second binding position after the first binding process, and a time T36 means a time to perform the second binding process after the binding teeth 322 moves to the second binding position. After the time T26, a waiting time T26*a* is set.

As illustrated in FIG. 20, the predetermined waiting time T26*a* is set after the first binding process is completed and the binding teeth 322 moves. This reduces the vibration of the binding unit 310*a* that has moved before the second binding process, improves the alignment accuracy between the bound portions formed by the first binding process and the bound portions formed by the second binding process, and strengthens the binding force.

Next, a description is given of the post-processing apparatus according to a third embodiment of the present disclosure.

The controller may control the binding unit 310*b* by an operational control combining the operational control of the binding unit 310 according to the first embodiment already described above and the operational control of the binding unit 310*a* according to the second embodiment already described above.

The structure related to the binding unit and the mechanism that executes the operational control include the structure and the mechanism of the first embodiment and the second embodiment. The binding unit according to the present embodiment executes the binding processes at two binding positions described in the first embodiment and the second embodiment a plurality of times.

For example, as illustrated in the first embodiment and the second embodiment, the speed when the binding unit moves from the home position to the first binding position is set faster than the speed when the binding unit moves from the first binding position to the second binding position. Subsequently, the binding unit moves faster from the second binding position to a third binding position and moves slower from the third binding position to a fourth binding position.

The above-described control moves the binding teeth 322 slowly in one set of binding processes executed at binding positions next to each other, that is, a set of the first binding process and the second binding process, or a set of a third binding process and a fourth binding process. This control improves the alignment accuracy between the bound portions formed by the set of the binding processes and strengthens the binding force.

Moreover, the above-described control improves the efficiency of the entire binding processes. A meaning of improving the efficiency of the entire binding processes includes, for example, shortening a time required for predetermined binding processes for one sheet bundle 5, or shortening a time required for all predetermined binding processes for a plurality of sheet bundles 5. In addition, the meaning of improving the efficiency of the entire binding processes includes avoiding repetition of the binding processes caused by unstable binding state. The above-described control strengthens the binding force to maintain a stable binding state of the sheet bundle 5 once subjected to the binding processes.

An image forming system 1 according to the present embodiment is described below with reference to FIG. 21.

Figure 21:
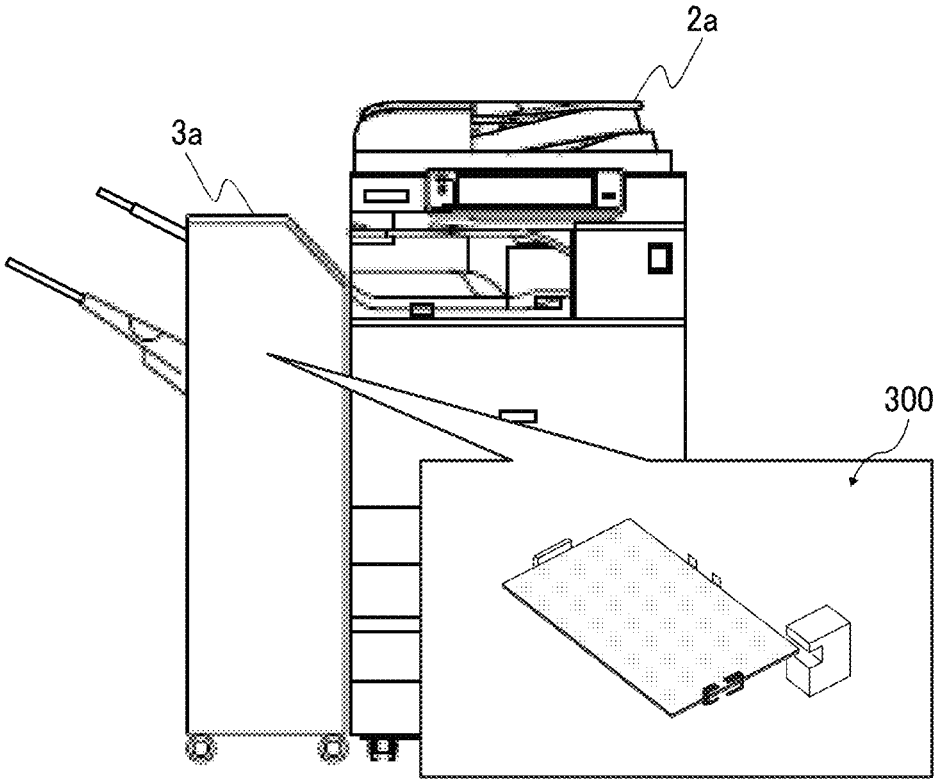
FIG. 21 is a diagram illustrating an image forming system according to the present disclosure.

FIG. 21 is a diagram illustrating an image forming system 1 according to the present embodiment. The image forming system includes the printer 2*a* and the post-processing apparatus 3*a* coupled to the printer 2*a* as a subsequent stage of the printer 2*a*. The post-processing apparatus 3*a* includes the binding device 300 described in the above embodiment. In the image forming system 1, the printer 2*a* may include the controller to control the binding device 300.

The printer 2*a* forms the image on both sides or one side of the sheet 4 based on image data input from an external device such as a personal computer or image data read by a scanner included in the copier. Although the printer 2*a* in the present embodiment employs an electrophotographic system as an image forming method, the printer 2*a* may employ any other method such as an inkjet method or a thermal transfer method.

The present disclosure is not limited to the above-described embodiments, and the configuration of the present embodiment can be appropriately modified other than suggested in each of the above embodiments within a scope of the technological concept of the present disclosure. Also, the positions, the shapes, and the number of components are not limited to the embodiments, and may be modified suitably in implementing the present disclosure.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

Any one of the above-described operations may be performed in various other ways, for example, in an order different from that described above.

Each of the functions of the described embodiments may be implemented by one or more processing circuits or control circuitry. Processing circuits includes a programmed processor, as a processor includes control circuitry. A processing circuit also includes devices such as an application specific integrated circuit (ASIC), digital signal processor (DSP), field programmable gate array (FPGA), and conventional circuit components arranged to perform the recited functions.

What is claimed is:

1. A post-processing apparatus comprising:

a binding tool configured to bind a sheet bundle;

a binding tool driver configured to apply a driving force to move the binding tool to a first binding position at which the binding tool executes a first binding process on the sheet bundle and a second binding position different from the first binding position and at which the binding tool executes a second binding process on the sheet bundle; and control circuitry configured to cause the binding tool driver to:

move the binding tool to the first binding position at a first movement speed to execute the first binding process, and move the binding tool from the first binding position to the second binding position at a second movement speed slower than the first movement speed to execute the second binding process.

2. The post-processing apparatus according to claim 1, wherein the binding tool driver includes a driver configured to apply a driving force to move the binding tool to at least one of the first binding position and the second binding position, and wherein the control circuitry is configured to cause the driver to move at the second movement speed slower than the first movement speed.

3. The post-processing apparatus according to claim 1, wherein the binding tool driver includes a first driver configured to apply a driving force to move the binding tool to the first binding position and a second driver configured to apply a driving force to move the binding tool to the second binding position and a driving force by which the binding tool executes the first binding process and the second binding process, and wherein the control circuitry is configured to:

cause the first driver to move the binding tool to the first binding position, cause the second driver to apply a first driving force to the binding tool to execute the first binding process, after the first binding process, cause the second driver to apply a second driving force smaller than the first driving force to the binding tool and move the binding tool from the first binding position to the second binding position, and cause the second driver to apply the first driving force to the binding tool to execute the second binding process.

4. The post-processing apparatus according to claim 3, wherein the control circuitry is configured to cause the second driver to temporarily stop applying the second driving force after the binding tool moves to the second binding position.

5. The post-processing apparatus according to claim 3, wherein the first driver and the second driver are electric motors, and wherein the control circuitry is configured to control rotational speeds of the electric motors to adjust the first driving force and the second driving force.

6. The post-processing apparatus according to claim 1, wherein the control circuitry is configured to control the binding tool driver based on a number of sheets of recording media in the sheet bundle.

7. An image forming apparatus comprising:

an image forming section configured to form images on sheets of recording media;

a conveyance unit configured to convey the sheets of recording media on which images are formed in the image forming section; and the post-processing apparatus according to claim 1, the post-processing apparatus configured to stack, align, and bind the sheets of recording media conveyed by the conveyance unit.

8. An image forming system comprising:

an image forming apparatus configured to form images on sheets of recording media; and the post-processing apparatus according to claim 1, the post-processing apparatus configured to bind a sheet bundle including a plurality of sheets of recording media on which images are formed by the image forming apparatus.

9. An image forming system comprising:

an image forming apparatus configured to form images on sheets of recording media;

a post-processing apparatus including:

a binding tool configured to bind a sheet bundle including the sheets of recording media; and a binding tool driver configured to apply a driving force to move the binding tool to a first binding position at which the binding tool executes a first binding process on the sheet bundle and a second binding position at which the binding tool executes a second binding process on the sheet bundle; and control circuitry in at least one of the image forming apparatus and the post-processing apparatus, the control circuitry configured to cause the binding tool driver to:

move the binding tool to the first binding position at a first movement speed to execute the first binding process; and move the binding tool from the first binding position to the second binding position at a second movement speed slower than the first movement speed to execute the second binding process.

* * * * *